US011591141B2

(12) United States Patent
Goodall

(10) Patent No.: US 11,591,141 B2
(45) Date of Patent: Feb. 28, 2023

(54) CLOSURES AND VESSELS WITH CLOSURES

(71) Applicant: VERASEAL PTY LIMITED, Sydney (AU)

(72) Inventor: Mark Donald Goodall, Vaucluse (AU)

(73) Assignee: Veraseal Pty Limited, Sydney (AU)

( * ) Notice: Subject to any disclaimer, the term of this patent is extended or adjusted under 35 U.S.C. 154(b) by 0 days.

(21) Appl. No.: 16/923,573

(22) Filed: Jul. 8, 2020

(65) Prior Publication Data

US 2022/0009678 A1 Jan. 13, 2022

(51) Int. Cl.
*B65D 39/00* (2006.01)
*B65D 41/02* (2006.01)
(Continued)

(52) U.S. Cl.
CPC ..... *B65D 43/161* (2013.01); *B65D 41/005* (2013.01); *B65D 41/325* (2013.01);
(Continued)

(58) Field of Classification Search
CPC ..... B65D 43/161; B65D 41/005; B65D 41/325; B65D 41/46; B65D 41/185; B65D 41/3447; B65D 41/0414; B65D 2251/06; B65D 2251/1066; B65D 2543/00518; B65D 2543/00092; B65D 2543/00296; B65D 2543/00972; B65D 2543/00018; B65D 2543/00481; B65D 2251/20;
(Continued)

(56) References Cited

U.S. PATENT DOCUMENTS 1,998,646 A * 4/1935 Yager ..... A61J 11/02 215/11.5
2,266,270 A * 12/1941 Roth ..... B65D 41/02 215/317
(Continued)

FOREIGN PATENT DOCUMENTS

AU 3420678 A 9/1979
AU 79156/91 A 1/1992
(Continued)

OTHER PUBLICATIONS

Sykes J, PCO—1815 Voluntary Standard 28mm CSD Finish, Drawing No. 1165363-2, May 29, 1998, Husky Injection Molding Systems Ltd., available at https://www.isbt.com/assets/Threadspecs/pco1815.pdf, retrieved Sep. 18, 2021.
(Continued)

*Primary Examiner* — Gideon R Weinerth

(57) ABSTRACT

A closure can close an outlet of a vessel. The vessel outlet can comprise a tubular cavity with an interior surface. The closure can comprise a male portion comprising a distal undersized portion, a proximal oversized portion, and a taper between the undersized and oversized portion. The male portion can be inserted in the vessel outlet, undersized portion first. Interference between the inner diameter of the vessel outlet and the outer diameter of male portion can occur when the male portion is sufficiently inserted. The interference can cause the undersized portion to flare out and engage the interior surface of the tubular cavity, thereby providing a seal.

20 Claims, 25 Drawing Sheets

(51) Int. Cl.

| | |
|---|---|
| ***B65D 41/18*** | (2006.01) |
| ***B65D 43/04*** | (2006.01) |
| ***B65D 43/16*** | (2006.01) |
| ***B65D 41/00*** | (2006.01) |
| ***B65D 41/32*** | (2006.01) |
| ***B65D 41/46*** | (2006.01) |
| *B65D 41/04* | (2006.01) |

(52) U.S. Cl.
CPC ..... *B65D 41/46* (2013.01); *B65D 41/0414* (2013.01); *B65D 2251/06* (2013.01); *B65D 2251/1066* (2013.01); *B65D 2251/20* (2013.01)

(58) Field of Classification Search
CPC ..... B65D 2251/00953; B65D 2251/00962; B65D 2251/0099; Y10S 220/19
USPC ..... 215/354, 235, 237, 253, 254, 318, 320, 215/44, 45; 220/255; 422/547, 568
See application file for complete search history.

(56) References Cited

U.S. PATENT DOCUMENTS 2,732,870 A 1/1956 Nichols
2,746,632 A * 5/1956 Bramming ..... B65D 39/04 215/270
3,038,624 A * 6/1962 Wieckmann ..... B65D 41/0428 215/DIG. 1
3,074,579 A * 1/1963 Miller ..... B65D 41/0421 215/354
3,084,823 A * 4/1963 Reichstein ..... B65D 39/04 215/311
3,151,757 A * 10/1964 Martin ..... B65D 41/0428 215/DIG. 1
3,244,308 A * 4/1966 Esposito, Jr. ..... B65D 39/04 215/354
3,343,700 A * 9/1967 Heubl ..... B65D 41/185 215/320
3,380,610 A * 4/1968 Krieps ..... B65D 43/022 215/320
3,455,500 A * 7/1969 Wilcox ..... B65D 43/0212 229/125.17
3,473,685 A 10/1969 Karlan
3,494,496 A * 2/1970 Livingstone ..... B65D 47/36 215/320
3,556,338 A 1/1971 Wilkinson et al.
3,592,349 A 7/1971 Baugh
3,596,694 A * 8/1971 Jaeniche ..... B65D 39/04 215/45
3,620,437 A 11/1971 Kulp
3,688,942 A 9/1972 Mitchell et al.
3,717,287 A 2/1973 Marand
3,741,424 A 6/1973 Landen
3,869,057 A 3/1975 Miller
3,881,627 A * 5/1975 Davolt ..... B65D 41/0421 215/329
3,900,122 A * 8/1975 Dichter ..... B65D 39/04 215/43
3,948,404 A 4/1976 Collins et al.
3,982,649 A * 9/1976 Wanderer ..... B65D 39/088 220/DIG. 19
3,987,921 A * 10/1976 Aichinger ..... B65D 41/04 215/307
3,990,598 A 11/1976 Zapp
3,991,895 A * 11/1976 Thornton ..... B65D 41/065 215/211
4,007,848 A 2/1977 Snyder
4,016,996 A * 4/1977 Aichinger ..... B65D 41/0414 215/344
4,090,631 A * 5/1978 Grussen ..... B65D 41/0421 215/329
4,098,422 A * 7/1978 Slomski ..... B65D 39/0017 215/320
4,206,852 A 6/1980 Dunn
4,441,637 A 4/1984 Libit
4,496,066 A 1/1985 Bullock, III
4,699,285 A 10/1987 Perne et al.
4,712,699 A 12/1987 Lutz
4,747,502 A 5/1988 Luenser
4,760,935 A * 8/1988 van den Beld ..... B60R 13/06 220/DIG. 19
4,801,040 A * 1/1989 Kraus ..... B62D 25/24 220/DIG. 19
4,856,668 A * 8/1989 Pfefferkorn ..... B65D 41/0421 215/329
4,874,102 A * 10/1989 Jessop ..... B01L 3/50825 215/273
4,956,103 A * 9/1990 Jessop ..... B01L 3/5021 210/787
5,008,066 A 4/1991 Mueller
5,186,344 A 2/1993 Cook
5,190,178 A 3/1993 Luch
5,207,783 A 5/1993 Burton
5,217,128 A 6/1993 Stenger
5,257,705 A 11/1993 de Santana
5,275,287 A * 1/1994 Thompson ..... B65D 41/0421 215/341
5,402,901 A 4/1995 Carvalheiro et al.
5,421,470 A * 6/1995 Dudzik ..... B65D 41/0435 215/354
5,464,112 A 11/1995 Guillot
5,489,036 A 2/1996 Arkins
5,533,633 A 7/1996 King
5,601,214 A 2/1997 Hendrickson
5,630,522 A * 5/1997 Montgomery ..... B65D 41/0421 215/344
5,730,309 A 3/1998 Jiradejnunt et al.
5,738,231 A * 4/1998 Montgomery ..... B65D 55/02 215/44
5,785,196 A * 7/1998 Montgomery ..... B65D 41/0414 215/354
5,791,473 A * 8/1998 Decker ..... G03C 3/00 220/366.1
5,916,525 A * 6/1999 Husar ..... B65D 41/0414 422/547
5,954,215 A 9/1999 Alter
6,041,953 A 3/2000 Goodall
6,145,688 A 11/2000 Smith
6,679,395 B1 * 1/2004 Pfefferkorn ..... B65D 51/1661 215/DIG. 1
6,702,134 B2 3/2004 Scalese
7,055,710 B2 * 6/2006 King ..... B65D 41/0421 215/344
7,182,213 B2 2/2007 King
7,743,952 B2 * 6/2010 Auer ..... B65D 41/185 215/354
8,091,724 B2 1/2012 King
9,366,374 B2 * 6/2016 Krauer ..... F16L 55/132
10,034,793 B2 * 7/2018 Leise, Jr. ..... A61F 5/4404
10,246,227 B2 * 4/2019 Wada ..... B65D 43/22
2003/0057174 A1 * 3/2003 Folchini ..... B65D 41/48 215/253
2004/0035818 A1 2/2004 King
2005/0284836 A1 12/2005 Majoor
2006/0138073 A1 * 6/2006 Ooka ..... B65D 41/3428 215/354
2013/0256329 A1 * 10/2013 Belfance ..... B29D 22/003 156/69
2014/0319162 A1 * 10/2014 Bois ..... B65D 43/169 220/849
2016/0060001 A1 * 3/2016 Wada ..... B65D 43/162 220/810
2017/0096281 A1 * 4/2017 Tiesberger ..... B65D 81/268
2018/0002076 A1 * 1/2018 Wada ..... B65D 43/162
2020/0031531 A1 * 1/2020 Hanan ..... B65D 41/38
2020/0172298 A1 * 6/2020 Wada ..... B65D 41/325

(56) References Cited

U.S. PATENT DOCUMENTS

| | | | | |
|---|---|---|---|---|
| 2021/0206545 | A1* | 7/2021 | Krautkramer | B65D 39/08 |
| 2022/0009678 | A1* | 1/2022 | Goodall | B65D 41/165 |

FOREIGN PATENT DOCUMENTS

| | | | |
|---|---|---|---|
| CA | 1181037 | | 1/1985 |
| EP | 0508668 | A1 | 10/1992 |
| EP | 0844190 | A1 | 5/1998 |
| EP | 0844190 | B1 | 1/2002 |
| EP | 1627821 | B1 | 5/2007 |
| GB | 2268734 | A | 1/1994 |
| JP | 2001276179 | | 10/2001 |
| JP | 2001276179 | A | 10/2001 |
| WO | 90/06266 | | 6/1990 |
| WO | WO2005012125 | A1 | 2/2005 |
| WO | PCT/AU2021/050713 | | 7/2021 |

OTHER PUBLICATIONS

Notification of Transmittal of the International Search Report and the Written Opinion of the International Searching Authority and the International Search Report in International Application No. PCT/AU2021/050713 (which claims priority to the instant U.S. Appl. No. 16/923,573) dated Sep. 24, 2021, 8 pages.

Written Opinion of the International Searching Authority in International Application No. PCT/AU2021/050713 (which claims priority to the instant U.S. Appl. No. 16/923,573) dated Sep. 24, 2021, 9 pages.

Re-Exam U.S. Appl. No. 90/014,050, filed Nov. 22, 2017, 283 pages.

Notice of Assignment of Re-Examination Request received in U.S. Appl. No. 90/014,050, dated Dec. 7, 2017, 1 page.

Notice of Re-Examination Request Filing Date received in U.S. Appl. No. 90/014,050, dated Dec. 7, 2017, 1 page.

Litigation Search Report received in U.S. Appl. No. 90/014,050, dated Dec. 7, 2017, 17 pages.

Transmittal filed in U.S. Appl. No. 90/014,050, filed Dec. 21, 2017, 6 pages.

Ex Parte Reexamination Communication and Interview Summary received in U.S. Appl. No. 90/014,050, dated Dec. 26, 2017, 3 pages.

Decision on Request for Reexamination received in U.S. Appl. No. 90/014,050, dated Jan. 17, 2018, 17 pages.

Office Action in Ex Parte Reexamination received in U.S. Appl. No. 90/014,050, dated Apr. 4, 2018, 14 pages.

Transmittal, Patent Owner Statement, Power of Attorney, and Certificate of Service filed in U.S. Appl. No. 90/014,050, filed May 8, 2018, 12 pages.

Examiner Interview Summary and OA Appendix received in U.S. Appl. No. 90/014,050, dated May 17, 2018, 28 pages.

Notice of Acceptance of POA received in U.S. Appl. No. 90/014,050, dated May 18, 2018, 2 pages.

Response to Non-Final Office Action in Ex Parte Reexamination, Certificate of Service and Interview Summary filed in U.S. Appl. No. 90/014,050, filed Jun. 4, 2018, 71 pages.

Litigation Search Report received in U.S. Appl. No. 90/014,050, dated Aug. 21, 2018, 76 pages.

Notice of Intent to Issue Ex Parte Reexamination Certificate received in U.S. Appl. No. 90/014,050, dated Oct. 2, 2018, 12 pages.

Comments on Statement of Reasons for Patentability filed in U.S. Appl. No. 90/014,050, filed Oct. 10, 2018, 6 pages.

Ex Parte Reexamination Certificate received in U.S. Appl. No. 90/014,050, dated Oct. 29, 2018, 2 pages.

Petition to Withdraw Attorney or Agent filed in U.S. Appl. No. 90/014,050, filed Apr. 16, 2020, 5 pages.

Notice of Acceptance of POA received in U.S. Appl. No. 90/014,050, dated Apr. 20, 2020, 2 pages.

Decision on Request to Withdraw Attorney or Agent received in U.S. Appl. No. 90/014,050, dated May 4, 2020, 2 pages.

Mail Returned to USPTO-Decision on Request to Withdraw Attorney or Agent in U.S. Appl. No. 90/014,050, 2 pages.

* cited by examiner

CLOSURES AND VESSELS WITH CLOSURES

TECHNICAL FIELD

Embodiments of the technology relate generally to closures and more particularly to systems for closing vessels.

BACKGROUND

Conventional technologies underserve various aspects of closing vessels and closures. Need exists for closures that offer improvements relating to usability, comfort, convenience, sealing, material waste, environmental impact, fabrication, and/or economics. Need further exists for closures that can remain attached to an associated vessel after opening. Need further exists for closures and vessels formed of the same material to promote recycling. Need further exists for closures that resist spillage. Need further exists for closures that are conducive to sterilization. Need further exists for closures having forms that are conducive to molding with reduced or manageable undercuts. Need further exists for closures that can seal carbonated beverages and for such closures that are captive. Need further exists for closures and vessel that resist spewing or unwanted pressure-driven overflow. Need further exists for closures that can be conveniently opened, used, closed, toted, opened again, and used again. A technology addressing one or more such needs, or some related deficiency in the art, would benefit the field.

SUMMARY

A closure can close an outlet (or an inlet) of a vessel, for example a top of a bottle containing a liquid, solid, or other material or combination of materials, or an end of a tube that conveys gas, liquid, sludge, fluid, or other appropriate material or combination of materials. Such material(s) may be intended for human consumption, for example beverages or solid foods or medicines, or nonedible or non-potable, for example industrial or household chemicals, samples, specimens, supplies, and so forth. In some examples, closing the outlet can comprise providing a seal to prevent material from moving out of (or into) the vessel. In some examples, closing the outlet can comprise providing a seal between two vessels so that material can move between the two vessels, such as by providing a joint between respective ends of two tubes.

In an aspect of the disclosure, a vessel outlet can comprise a cavity and a closure can comprise a member configured for insertion in the vessel outlet. A portion of the member can be diametrically oversized relative to the cavity. Insertion of the member in the vessel outlet can produce interference between that portion of the member and the cavity. The interference can produce deflection of another portion of the member to result in sealing the vessel outlet.

In an aspect of the disclosure, a pull ring can support opening the vessel or closing the vessel or toting the vessel or any combination of opening, closing, and toting the vessel.

In an aspect of the disclosure, a skirt or flared lip can support opening the vessel or closing the vessel or opening and closing the vessel.

The foregoing discussion about closing vessels is for illustrative purposes only, without being exhaustive. Various aspects of the present disclosure may be more clearly understood and appreciated from a review of the following text and by reference to the associated drawings and the claims that follow. Other aspects, systems, methods, features, advantages, and objects of the present disclosure will become apparent to those with skill in the art upon examination of the following drawings and text. It is intended that all such aspects, systems, methods, features, advantages, and objects are to be included within this description and covered by this paper and by the appended claims.

BRIEF DESCRIPTION OF THE FIGURES

FIG. 1, are illustrations of a closure and an associated vessel in accordance with some example embodiments of the disclosure.

FIG. 2, are illustrations further describing representative function and features of the closure of FIG. 1, with FIG. 2D illustrating a representative variation, in accordance with some example embodiments of the disclosure.

FIG. 3, are illustrations further describing representative operation and features of the closure of FIGS. 1 and 2 with utilization of a finite element analysis (FEA) computer model in accordance with some example embodiments of the disclosure.

FIG. 4, are illustrations of other closures in accordance with some example embodiments of the disclosure.

FIG. 7, are illustrations of other closures in accordance with some example embodiments of the disclosure.

FIG. 8, are illustrations of a closure and associated vessel outlet comprising pressure venting channels in accordance with some example embodiments of the disclosure.

FIG. 11, are illustrations of another closure and associated vessel that is resealable and provides a pull ring for toting in accordance with some example embodiments of the disclosure.

FIG. 12, are illustrations of another closure and associated vessel in accordance with some example embodiments of the disclosure.

FIG. 14, are illustrations of another closure and associated vessel in accordance with some example embodiments of the disclosure.

Figures 1A, 1B, 1C:
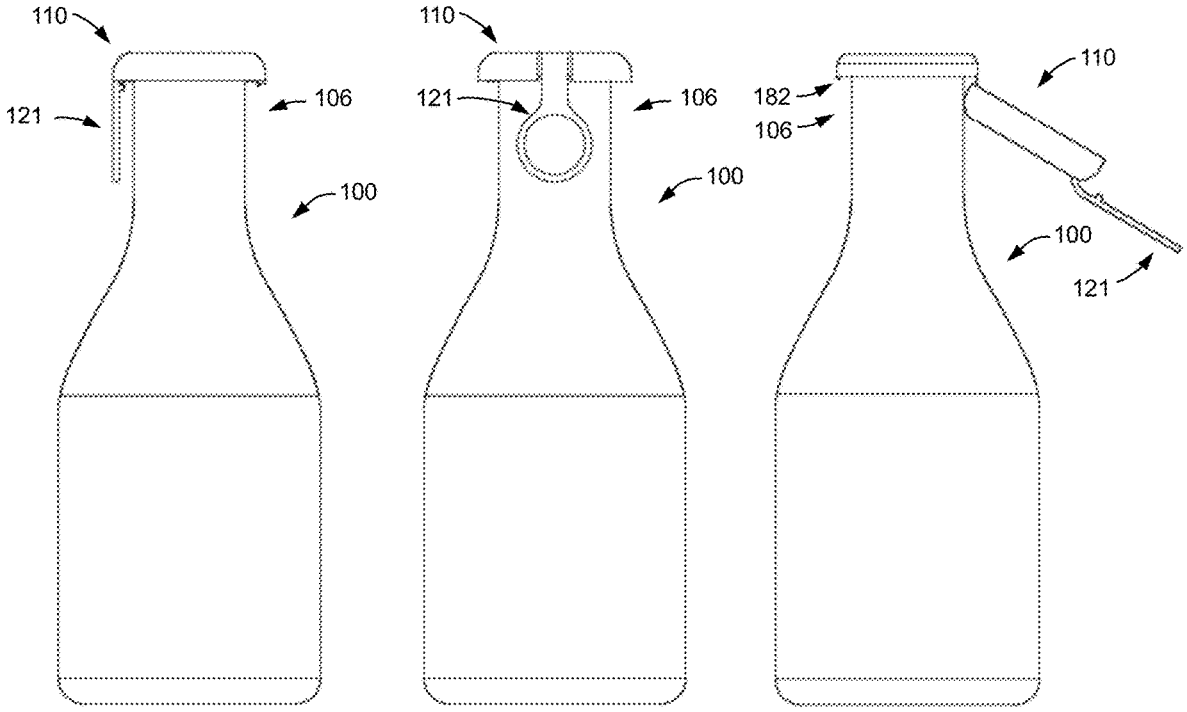
FIGS. 1A, 1B, 1C, 1D, 1E, 1F, 1G, 1H, 1I, 1J, 1K, 1L, and 1M, collectively

Many aspects of the disclosure can be better understood with reference to these figures. The elements and features shown in the figures are not necessarily to scale, emphasis being placed upon clearly illustrating principles of example embodiments of the disclosure. Moreover, certain dimensions may be exaggerated to help visually convey such principles. In the figures, reference numerals often designate like or corresponding, but not necessarily identical, elements throughout the several views.

DETAILED DESCRIPTION OF EXAMPLE EMBODIMENTS

The technology will be discussed more fully hereinafter with reference to the figures, which provide additional information regarding representative or illustrative embodiments of the disclosure. The present technology can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples," "embodiments," and "exemplary embodiments" provided herein are intended to be non-limiting and among others supported by representations of the disclosure.

Those of ordinary skill in the art having benefit of this disclosure will be able, without undue experimentation, to combine compatible elements and features that are described at various places in this written description, which includes text and illustrations. That is, the illustrations and specification are organized to facilitate practicing numerous combinations, such as by combining an element of one illustrated embodiment with another element of another illustrated embodiment or by combining a feature disclosed in an early paragraph of the specification with another element disclosed in a later paragraph of the specification.

This document includes sentences, paragraphs, and passages (some of which might be viewed as lists) disclosing alternative components, elements, features, functionalities, usages, operations, steps, etc. for various embodiments of the disclosure. Unless clearly stated otherwise, all such lists, sentences, paragraphs, passages, and other text are not exhaustive, are not limiting, are provided in the context of describing representative examples and variations, and are among others supported by various embodiments of the disclosure. Accordingly, those of ordinary skill in the art having benefit of this disclosure will appreciate that the disclosure is not constrained by any such lists, examples, or alternatives. Moreover, the inclusion of lists, examples, embodiments, and the like (where provided as deemed beneficial to the reader) may help guide those of ordinary skill in practicing many more implementations and instances that embody the technology without undue experimentation, all of which are intended to be within the scope of the claims.

In some instances, a process or method (for example of using, making, or practicing) may be discussed with reference to a particular illustrated embodiment, application, or environment. Those of skill in the art will appreciate that any such references are by example and are provided without limitation. Accordingly, the disclosed processes and methods can be practiced with other appropriate embodiments supported by the present disclosure and in other appropriate applications and environments. Moreover, one of ordinary skill in the art having benefit of this disclosure will be able to practice many variations of the disclosed methods, processes, and technologies as may be appropriate for various applications and embodiments.

The term "pull ring," as used herein, generally refers to something that a user pulls as an aid to opening a vessel, such as a ring, a band, a loop, a circle, an oval, a hoop, a handle, a cord or strap, or a member comprising an aperture and intended to be grasped, held, hooked, or otherwise engaged by hand or finger.

The term "fasten," as used herein, generally refers to physically coupling something to something else firmly or securely.

The term "fastener," as may be used herein, generally refers to an apparatus or system that fastens something to something else, whether releasably, temporarily, or permanently.

The term "couple," as may be used herein, generally refers to joining, connecting, or associating something with something else.

As one of ordinary skill in the art will appreciate, the term "operably coupled," as may be used herein, encompasses direct coupling and indirect coupling via another, intervening component, element, or module; moreover, a first component may be operably coupled to a second component when the first component comprises the second component.

As one of ordinary skill in the art will appreciate, the term "approximately," as may be used herein, provides an industry-accepted tolerance for the corresponding term it modifies. Similarly, the term "substantially," as may be used herein, provides an industry-accepted tolerance for the corresponding term it modifies. Such industry-accepted tolerances range from less than one percent to twenty percent and correspond to, but are not limited to, component values, process variations, and manufacturing tolerance.

As appreciated by those of skill in the art, unless clearly specified otherwise, the values provided herein are intended to reflect commercial design practices or nominal manufacturing targets.

Figure 1D:
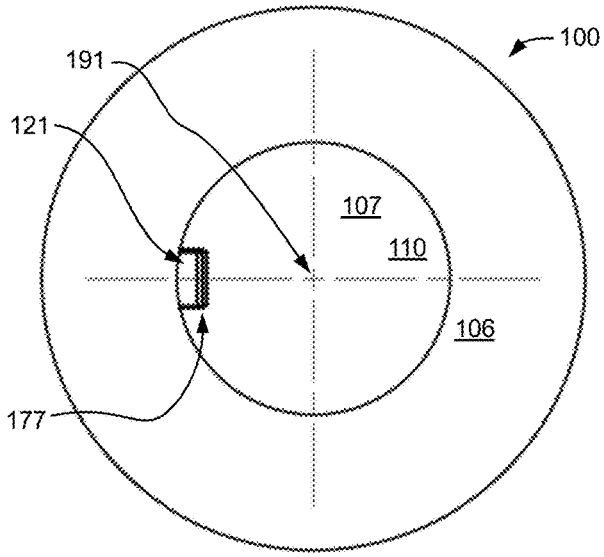
Figure 1E:
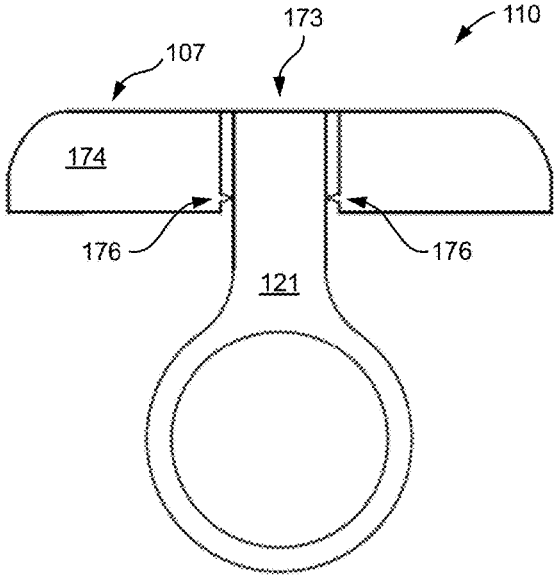

Turning now to FIGS. 1A, 1B, 1C, 1D, 1E, 1F, 1G, 1H, 1I, 1J, 1K, 1L, and 1M, these figures illustrate an example closure 110 and an example associated vessel 100 according to some embodiments of the disclosure. FIG. 1A illustrates a side view of the vessel 100 and closure 110 in a closed configuration with a pull ring 121 on the left side. FIG. 1B illustrates another closed-configuration side view, rotated 90 degrees relative to the view of FIG. 1A so the pull ring 121 faces out of the page. FIG. 1C illustrates a side view taken from the same perspective as the view of FIG. 1A but with the vessel 100 in a fully open configuration. FIG. 1D illustrates a top view of the vessel 100 and closure 110 in the closed configuration, with the pull ring 121 largely hidden from view by a base 107 of the closure 110. FIG. 1E illustrates a magnified view of the closure 100 corresponding to the view of FIG. 1B.

Figure 1F:
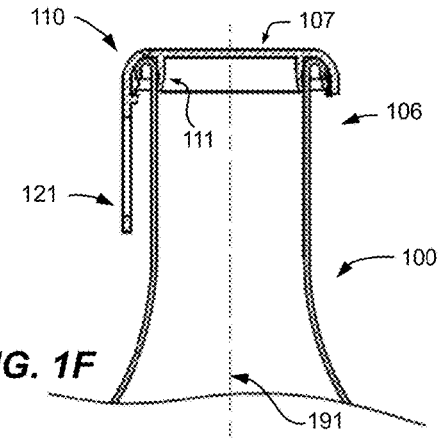
Figure 1G:
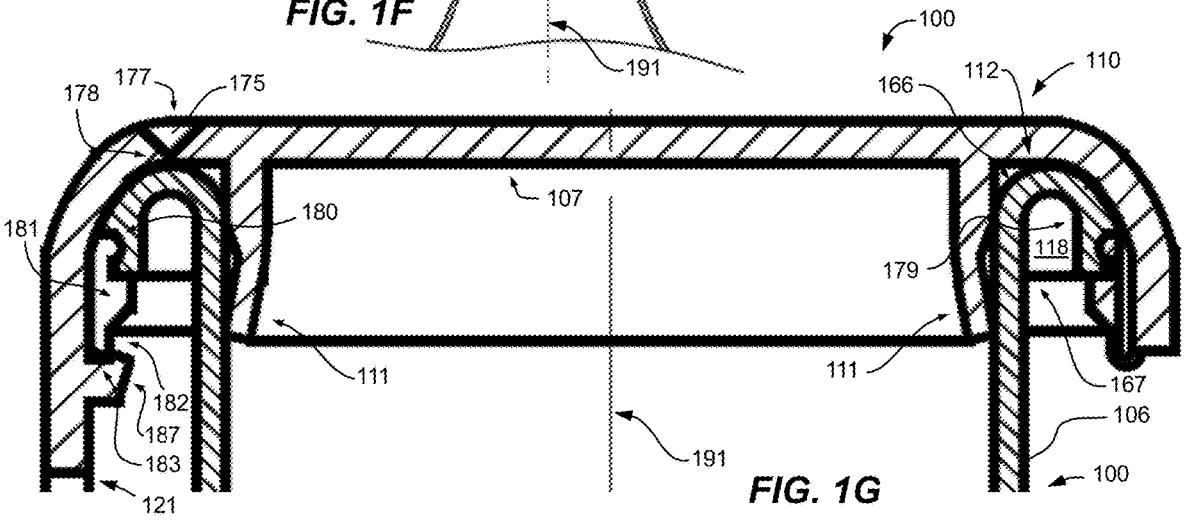

FIGS. 1F, 1G, 1H, 1I, 1J, 1K, 1L, and 1M describe progressive opening of the vessel 100. FIG. 1F illustrates a cross sectional view corresponding to the view of FIG. 1A, with the vessel 100 in the closed configuration. FIG. 1G illustrates a magnified view of an upper portion of FIG. 1F. The magnified view of FIG. 1G illustrates closure details, including the base 107 of the closure 110 and a male portion 111 that extends distally relative to the base 107.

The term "distal," as used herein with reference to an element of a body, generally refers to the element being situated away from a main or center of the body. The term "proximal," as used herein with reference to an element of a body, generally refers to the element being situated towards a main or center of the body. For example, in FIG.

1F, a first portion of the vessel 100 that is situated above a second portion of the vessel 100 (that is, the first portion is situated more toward closure 110 along an axis 191) can be characterized as distal to the second portion, and the second portion can be characterized as proximal to the first portion. Similarly, in FIG. 1G, an area of the male portion 111 of the closure 110 that is disposed farthest from the base 107 of the closure 110 can be characterized as distal to area of the male portion 111 that is closer to the base 107.

Figure 1H:
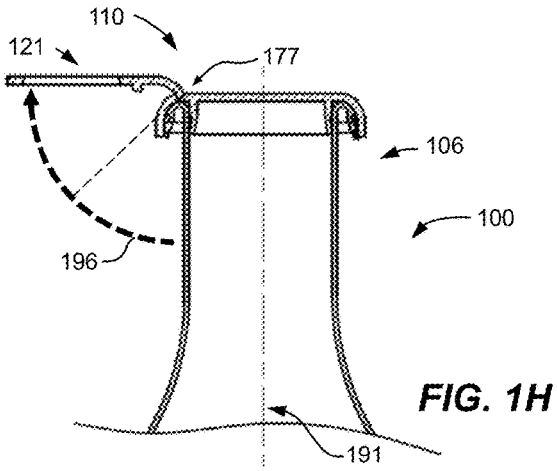
Figure 1I:
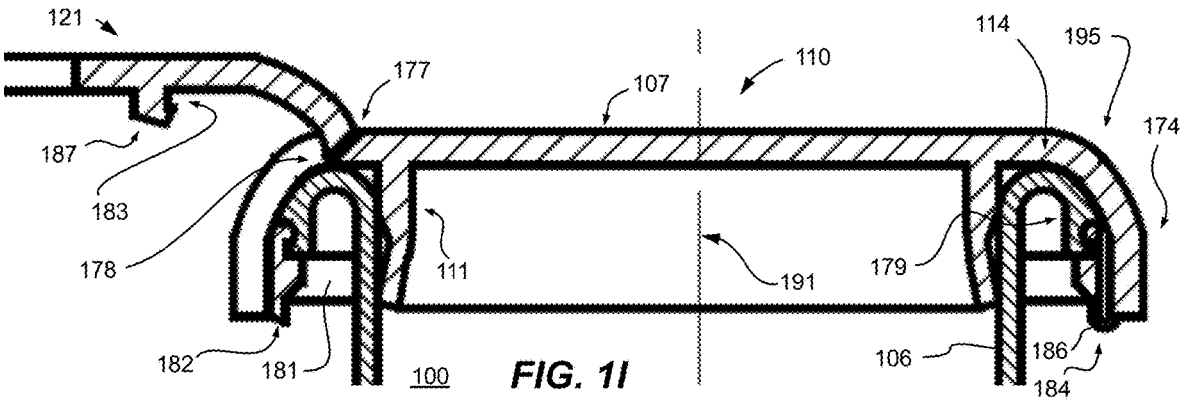

FIG. 1H illustrates a cross sectional view with the same perspective as FIG. 1F, with the closure 110 in an early stage of opening in which a user (not illustrated) has lifted the pull ring 121, for example using a rotational motion 196, and initiated opening of the vessel. As illustrated, the rotational motion 196 is about a hinge 177, further discussed below. FIG. 1I illustrates a magnified view of a portion of FIG. 1H that shows example closure details.

Figure 1J:
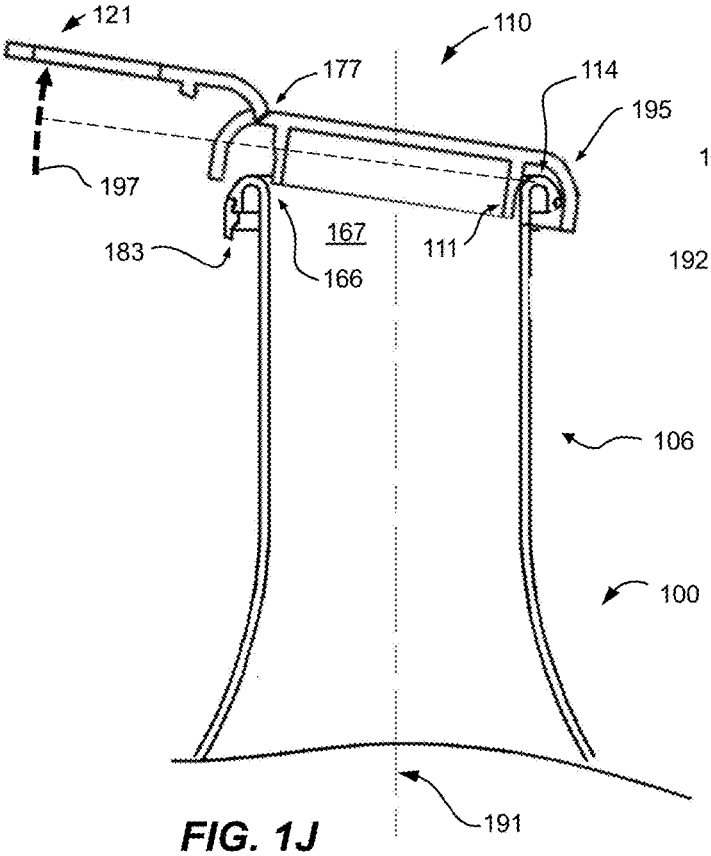

FIG. 1J illustrates a cross sectional view taken from the same perspective as FIG. 1H, with the closure 110 in a following stage of opening in which the user has pulled upward on the pull ring 121. As illustrated, the user has applied a rotation motion 197, with rotation about an opposite side 195 of the closure 110. In some example embodiments, the rotation motion 197 can be viewed as an extension of the rotational motion 196 illustrated in FIG. 1H.

Figure 1K:
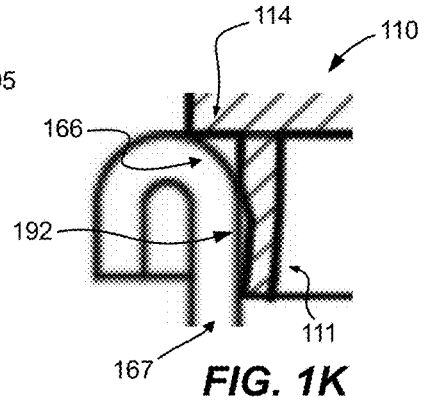
Figure 1L:
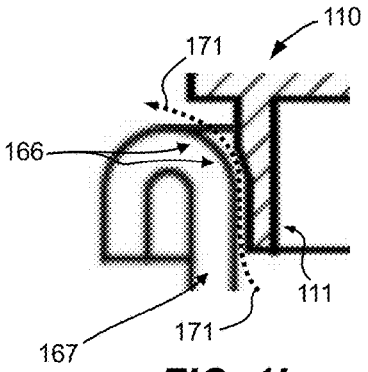

As illustrated in FIG. 1J and further detailed in FIGS. 1K and 1L (discussed below), the example vessel outlet 106 comprises an example mouth 167, which can be viewed as an embodiment of a female tubular cavity, and an example rim 114. As illustrated, the rim 114 comprises an example of a projecting rim. As illustrated, the rim 114 defines an example aperture. As illustrated in FIG. 1J, pulling upwards on the pull ring 121 has sufficiently extracted the male portion 111 of the closure 110 from the vessel outlet 106 to break the seal. As illustrated, in this configuration, the side of the male portion 111 adjacent the pull ring 121 is tilted up relative to the opposite side 195.

If the vessel 100 is pressurized, for example holding a carbonated beverage, breaking the seal can release the vessel's internal pressure. In the illustrated configuration, the vessel outlet 106 has a curved contour 166 at the mouth 167. More specifically, the contour 166 at and adjacent the illustrated rim 114 is curved when viewed in a cross section taken through the longitudinal axis 191 of the vessel 100. As used herein in reference to a vessel, "rim," "mouth," and "outlet" generally refer to portions or features of the vessel, with the vessel outlet encompassing the mouth and with the mouth encompassing the rim. As used herein, "rim" generally refers to a distal portion or feature of a mouth and "mouth" generally refers to a distal portion or feature of an outlet. The term "aperture," as used herein, refers to an opening, hole, slit, or gap and has sufficient breadth that a wide variety of rims, mouths, and outlets are within the scope of the word "aperture."

The curved contour 166 in cooperation with sealing features of the male portion 111 of the closure 110 (further discussed below with reference to FIGS. 2A, 2B, and 2C) can vent pressure gradually during opening. Venting pressure gradually can avoid unwanted overflow or spewing of carbonated beverages that may occur with many conventional designs when pressure drops abruptly. FIG. 1K illustrates a magnified cross sectional side view showing the mouth 167 and sealing features of the male portion 111 with the closure 110 in a sealed configuration, prior to breaking the seal. FIG. 1L illustrates a magnified cross sectional view showing the mouth 167 and sealing features of the male portion 111 of the closure 110 as the seal is broken during opening. In the illustrated sealing configuration of FIG. 1K, in the illustrated cross sectional view, the male portion 111 forms an enclosed gap 192 adjacent or at the curved contour 166, the vessel outlet 106, or the mouth 167. As illustrated in FIG. 1L, a pressure venting path 171 opens through the gap 192 during vessel opening that facilitates gradual release of pressure, thereby avoiding an abrupt pressure drop that can be associated with spewing or unwanted pressure-driven flow from the vessel 100. Such pressure venting can further help avoid uncontrollable cap blow off of a sealed carbonated beverage, for example.

Figure 1M:
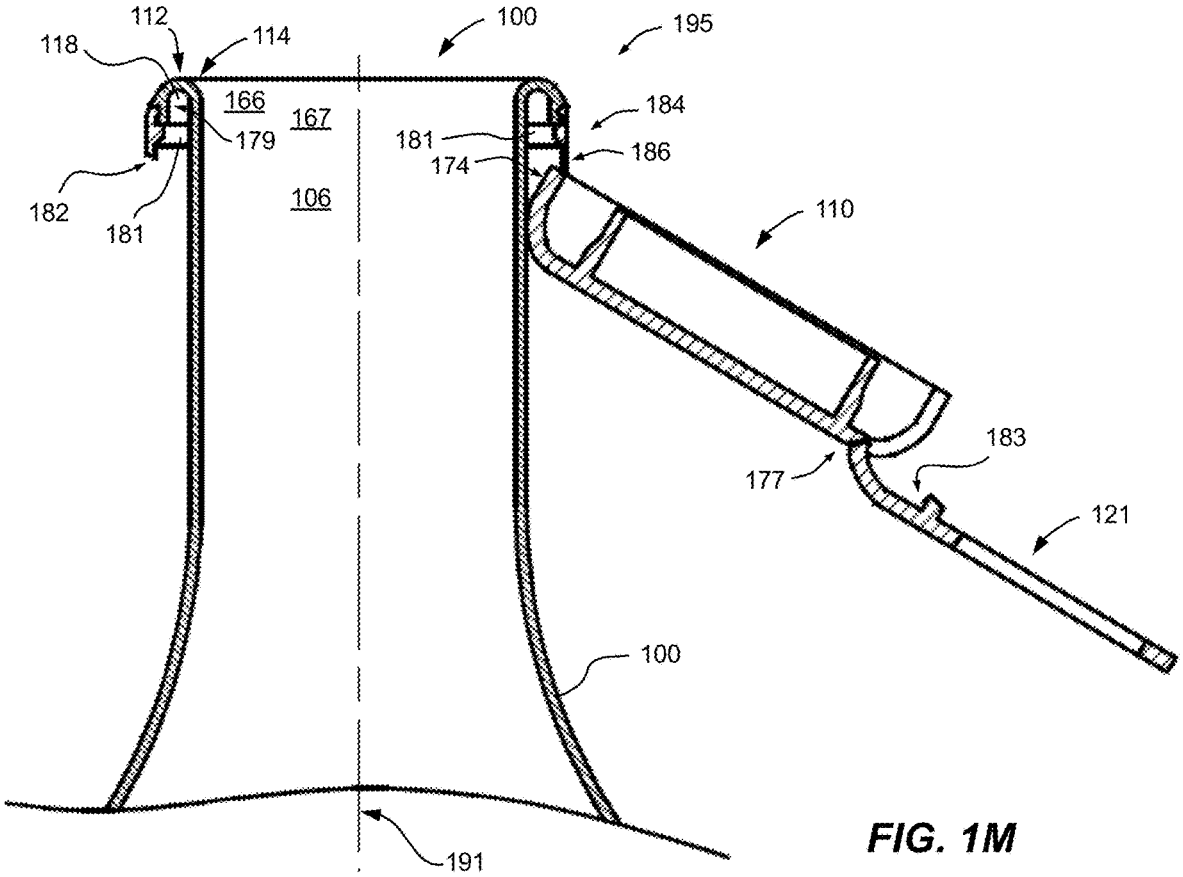

FIG. 1M illustrates a cross sectional view with the same perspective as FIG. 1J, with the closure 110 in a fully open configuration in which the user has pulled the pull ring 121 completely across the vessel outlet 106.

Example features generally associated with opening the vessel 100 will now be discussed in further. As illustrated in FIG. 1E, the pull ring 121 extends downward within a channel 173 that extends from the base 107 of the closure 110 along a side 174 of the closure 110. A frangible connection 176 joins the pull ring 121 to the sides of the channel 173. In the illustrated example, the frangible connection 176 comprises two points or locations where the material of the pull ring 121 continues to or fuses with the material of the closure side 174. The pull ring 121 is further joined to the base 107 of the closure 110 by the hinge 177, which is visible in FIGS. 1D, 1G, 1I, 1J, and 1M. As can be seen in FIG. 1G, in the illustrated example, the hinge 177 comprises a cutout area 175 and a thin region 178 that connects the closure base 107 to the pull ring 121.

When the user lifts the pull ring 121 as discussed above with reference to FIG. 1H, the frangible connection 176 severs and the pull ring 121 rotates about the hinge 177 (illustrated as the rotational motion 196). As the pull ring 121 rotates about the hinge 177, the cutout area 175 closes and the thin region 178 flexes as can be seen in FIG. 1I.

Referring now to FIG. 1G, the vessel 100 comprises the mouth 167 with the curved contour 166, as discussed above with reference to FIGS. 1J, 1K, and 1L. In the illustrated example, the curved contour 166 is associated with the vessel 100 comprising a curved-back portion 179 at the mouth 167. Thus, the illustrated mouth 167 can be viewed as curving back in connection with forming the curved contour 166.

In an example embodiment of the vessel 100 comprising a beverage container, the curved-back portion 179 forms the rim 114 with a three-dimensional contour 112 (see FIG. 1M) that contacts the user's lips and mouth comfortably, to provide a comfortable drinking experience. As shown in FIGS. 1G and 1M, in the illustrated embodiment, the curved back portion 179 forms an open area 118 that is void of vessel material. For certain applications, the void can support objectives related to cost, weight, and environmental impact associated with materials, for example saving plastic usage, and further can enhance strength and impact resistance of the rim 114. In some other embodiments, the three-dimensional contour 112 illustrated in FIG. 1M can alternatively be provided without utilizing the open area 118.

In some other example embodiments, a different mouth form or configuration, such as without any curving back, can provide an appropriately contoured surface. In some examples, an appropriately curved contour can be produced via machining on a lathe or other material removal process or via a plastic forming process such as injection molding or blow molding.

Referring to FIG. 1G, the illustrated example curved-back portion 179 comprises a circumscribing notch 180 in which a band 181 is partially disposed. In some example embodiments, the band 181 is a component that is attached to the curved-back portion 179 of the vessel 100. In some example embodiments, the band 181 is an integral seamless part of the curved-back portion 179 of the vessel 100. Accordingly, the features illustrated by FIG. 1G as part of the band 181 may be directly incorporated into the curved-back portion 179 of the vessel.

As illustrated by FIG. 1G, the band 181 circumscribes the curved-back portion 179 and comprises a projection 182 adjacent the pull ring 121. The pull ring 121 comprises a projection 187 that comprises a notch 183 in which the projection 182 is disposed. The projection 182 and notch 183 form a catch that retains the closure 110 on the vessel 100, with the male portion 111 disposed in the mouth 167 of the vessel 100. When the user lifts the pull ring 121 as discussed above, the notch 183 moves away from (and may open or distort) and releases the projection 182. The catch thus disengages. Accordingly, the user can readily lift the pull ring 121. Additionally, with the illustrated catch mechanism, the user can move the pull ring 121 back to its original location to re-engage the catch and close the vessel 100 with the male portion 111 of the closure 110 disposed in the mouth 167 of the vessel 100. Thus, the mechanism supports repeated opening and closing of the vessel 100, for example so the user can open the vessel 100, take a drink, and the close the vessel 100.

Referring now to FIGS. 1I and 1M, another hinge 184 connects the side 174 of the closure 110 to the band 181 on the opposite side 195 of the vessel 100 from the pull ring 121, projection 182, and notch 183. The illustrated example hinge 184 comprises a flexible strip of material 186 that extends between the band 181 and the closure side 174. As illustrated in FIG. 1M, the flexible strip of material 186 retains the closure 110 attached to the vessel 100 after the vessel 100 is fully opened.

In some example embodiments, the band 181, the closure 110, the pull ring 121, and the flexible strip of material 186 comprise a unitary element that may be formed from one material. Thus, the flexible strip of material 186, the band 181, the pull ring 121, and the closure 110 can be viewed as integral portions of one continuous element.

In some example embodiments, this continuous element is further integral with the vessel 100. The vessel 100, the flexible strip of material 186, the band 181, the pull ring, and the closure 110 can be formed of a common material and may be integral portions of one unitary element. In some example embodiments, the entirety of what is illustrated in FIGS. 1A, 1B, 1C, 1D, 1E, 1F, 1G, 1H, 1I, 1J, 1K, 1L, and 1M (or in FIG. 11) can be formed of a single polymer such as polyethylene terephthalate (PET or PETE), which can include additives or blends with other materials, or from other appropriate polymers or a combination of polymers. In some example embodiments, the entirety of what is illustrated in FIGS. 1A, 1B, 1C, 1D, 1E, 1F, 1G, 1H, 1I, 1J, 1K, 1L, and 1M (or in FIG. 11) can be formed in a molding operation, for example using injection molding or blow molding or insert molding, any of which can be performed in a single pass or in multiple passes in various embodiments. Fabrication will be further discussed below with reference to FIG. 10, which illustrates a blow molding preform.

In some example embodiments without limitation, the closure 110 (or other closures disclosed herein) can comprise PET, polyester, high-density polyethylene (HDPE), fluorine-treated HDPE, low-density polyethylene (LDPE), polycarbonate (PC), polypropylene (PP), polystyrene (PS), polyvinyl chloride (PVC), post-consumer resin (PCR), K-Resin (SBC), bioplastic, etc. or an appropriate combination thereof with or without appropriate additives (for example for enhanced stability, improved mechanical characteristics, visual appeal, or color).

In some example embodiments without limitation, the vessel 100 (or other vessels disclosed herein) can comprise PET, polyester, HDPE, fluorine-treated HDPE, LDPE, PC, PP, PS, PVC, PCR, SBC, bioplastic, etc. or an appropriate combination thereof with or without appropriate additives (for example for enhanced stability, improved mechanical characteristics, visual appeal, or color) or an inorganic material such as metal, metal alloy, glass, ceramic, etc.

In some example embodiments, the vessel 100 (or other vessels disclosed herein) is composed of aluminum, glass, or ceramic material, while the closure 100 (or other closures disclosed herein) is composed of a thermoplastic material.

In some example embodiments, without limitation, the closure 110 and the vessel 100 (or other closures and vessels disclosed herein) can have a common composition that can comprise PET, polyester, HDPE, fluorine-treated HDPE, LDPE, PC, PP, PS, PVC, PCR, SBC, bioplastic, etc. or an appropriate combination thereof with or without appropriate additives (for example for enhanced stability, improved mechanical characteristics, visual appeal, or color).

In some example embodiments, without limitation, the closure 110 and the vessel 100 (or other closures and vessels disclosed herein) can have compositions that are sufficiently compatible to support recycling together. For example, polymer resin of the vessel 100 and the closure 110 can both be PET based, with the vessel made of clear PET and the closure 110 made of PET with a colorant additive.

In some example embodiments, a molding process fabricates the closures 110 and the vessels 100 (or other closures and vessels disclosed herein) in quantity. The resulting products are filled with beverage and sold to consumers who consume the beverage and return the closures 110 and vessels 100 for recycle. Substantially equal numbers of the returned closures 110 and vessels 100 are collectively heated to form a melt comprising substantially equal numbers of melted closures 110 and melted vessels 100. This melt is then molded to create new closures 110 and new vessels 100, which are filled with beverage and sold to consumers so that the cycle can continue.

Figure 2A:
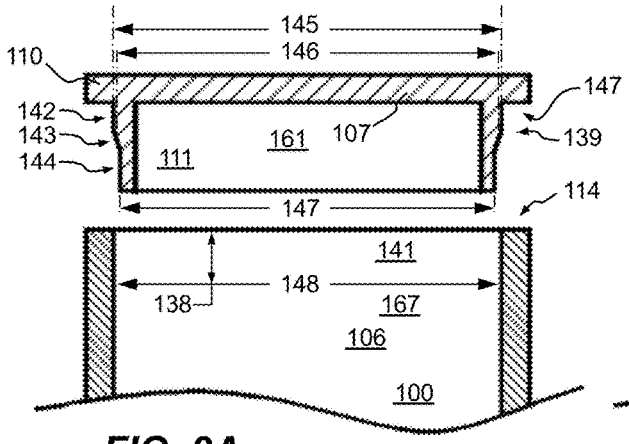
FIGS. 2A, 2B, 2C, and 2D, collectively
Figure 2B:
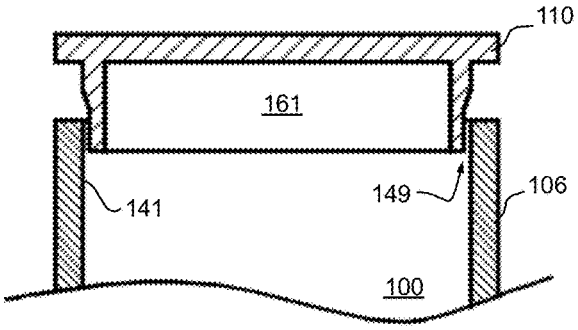
Figure 2C:
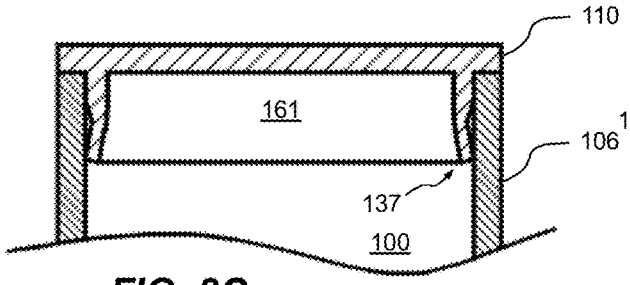
Figure 2D:
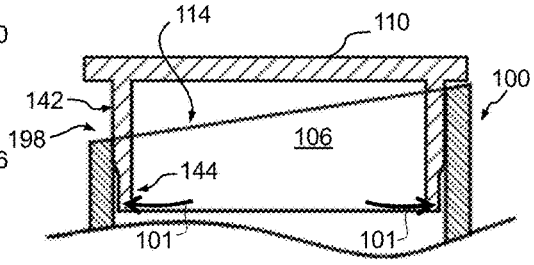

Turning now to FIGS. 2A, 2B, 2C, and 2D these figures illustrate example function and features of the closure 110 of FIG. 1 associated with sealing according to some embodiments of the disclosure. FIG. 2D illustrates a representative variation that will be discussed following FIGS. 2A, 2B, and 2C.

In the example illustrated by FIGS. 2A, 2B, and 2C, the vessel outlet 106 and the mouth 167 comprise an interior surface 141 that is straight walled and cylindrical. The interior surface 141 thus differs in shape from the curved contour 166 illustrated in FIG. 1 while providing corresponding sealing function. FIG. 2 illustrates an alternative embodiment and further illustrates representative operating principles in a manner intended to promote readership.

In the illustrated example of FIGS. 2A, 2B, and 2C, the vessel outlet 106 comprises a mouth 167 with a distal rim 114. The mouth 167 defines the interior surface 141 and can be viewed as an embodiment of a female tubular cavity.

The example closure 110 of FIG. 2 comprises the base portion 107 and the male portion 111 extending from the base portion 107. The male portion extends circumferentially to define a cavity 161. To close the vessel 100, the male portion 111 is disposed in the female tubular cavity with a shoulder 147 of the base portion 107 adjoining the rim 114 and a circumferential surface 139 of the male portion 111 facing the interior surface 141 of the vessel outlet 106 and mouth 167. As illustrated, the male circumferential surface 139 comprises an oversized portion 142, a tapered portion 143, and an undersized portion 144 that are progressively displaced from the base 107. In the illustrated example, the oversized portion 142 has an outer diameter 145 exceeding an inner diameter 148 of the mouth 167 of the vessel 100. In the illustrated embodiment of FIG. 2, the oversized portion 142, the tapered portion 143, and the undersized portion 144 have distinct geometries. However, in some embodiments, the oversized portion 142 and the tapered portion 143 are formed with a continuous taper. In some embodiments, the undersized portion 144 and the tapered portion 143 are formed with a continuous taper. In some embodiments, the oversized portion 142, the tapered portion 143, and the undersized portion 144 are formed with a continuous taper, for example as illustrated in FIG. 7E, which is discussed below.

For embodiments with the mouth 106 tapered outward or having a lead-in (for example with the curved contour 166 illustrated in FIG. 1 and discussed above), the outer diameter of the male portion 111 may exceed the female inner diameter at a location displaced a distance 138 from the rim 114, i.e., at a depth within the mouth 167 of the vessel 100. That is, the inner diameter 148 may vary such that the outer diameter 145 of the oversized portion 142 is smaller than the inner diameter 148 at or adjacent to the rim 114 but is but is larger than the inner diameter 148 at a specified distance 138 from the rim 114.

Referring to the embodiment illustrated in FIGS. 2A, 2B, and 2C, part of the male tapered portion 143 can have an outer diameter 146 equaling or exceeding the inner diameter 148 of the mouth 167. The undersized male portion 144 can have an outer diameter 146 that is smaller than the inner diameter 148 of the mouth 167. When the male portion 111 is partially inserted in the mouth 167, clearance or an annular space 149 can exist between the undersized male portion 144 and the interior surface 141 as can be seen in FIG. 2B. Once the male portion 111 is sufficiently inserted, interference occurs. The interference can cause the undersized male portion 144 to flare out or to diametrically expand as illustrated in FIG. 2C and engage the interior surface 141 of the outlet 106. This engagement of the resulting flared-out portion 137 can provide a seal. (See also FIG. 2D, in which deflection of the undersized male portion 144 is illustrated by arrows 101 representing force, rather than illustrating example physical deformation of the undersized male portion 144.)

In some example embodiments, the flaring out or diametrical expansion of the undersized male portion 144 occurs below the threshold of plastic deformation. In some example embodiments, the flaring out or diametrical expansion of the undersized male portion 144 occurs without plastic creep.

In another example embodiment, the portion identified with reference number "144" and referred to above as "the undersized portion" has an outer diameter 147 that substantially equals or that substantially matches the inner diameter 148 of the mouth 167. In such an embodiment, interference between the oversized portion 142 and the mouth 167 can produce diametrical expansion force or flaring out force of the portion 144, resulting in heightened lateral force to reinforce a seal.

In another example embodiment, the portion identified with reference number "144" and referred to above as "the undersized portion" has an outer diameter 147 that exceeds the inner diameter 148 of the mouth 167. In such an embodiment, insertion of that portion 144 may entail applying sufficient force to the closure 110 along the axis 191 (see FIG. 1D, inter alia) to deform that portion 144 and compress its diameter. In such an embodiment, additional interference between the oversized portion 142 and the mouth 167 can produce diametrical expansion force or flaring out force of the portion 144, resulting in heightened lateral force to reinforce a seal.

Figure 6:
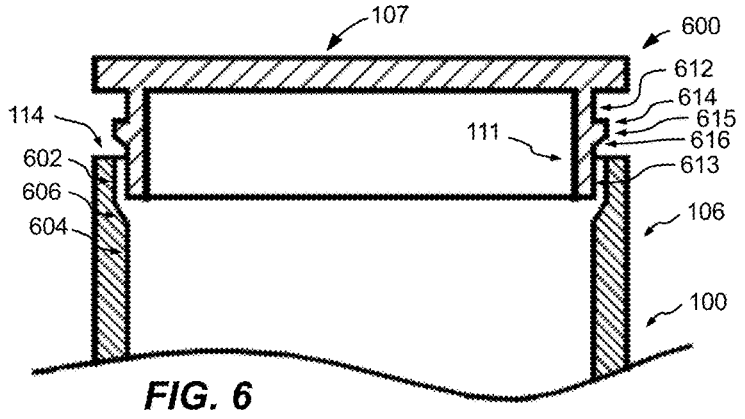
FIG. 6 is an illustration of another closure and associated vessel outlet in accordance with some example embodiments of the disclosure.

While FIGS. 2A, 2B, and 2C illustrate an example embodiment in which the interior surface 141 of the vessel outlet 106 adjacent the rim 114 is uniform and cylindrical, some other embodiments have additional contours and features. For example and as further discussed below, FIG. 6 illustrates a taper applied to an interior surface and FIGS. 7D and 7E illustrate embodiments in which an interior surface comprises a projection.

As discussed above, the example closure-sealing features that FIGS. 2A, 2B, and 2C illustrate can be combined with the example closure-retention features that FIG. 1 illustrates. Moreover, the closure 110 illustrated by FIGS. 2A, 2B, and 2C can be retained on vessels 100 using other closure-retention systems, for example the retention systems illustrated in FIG. 11, 12, 14, or 15 or other closure-retention systems disclosed herein in text or known in the art, without limitation.

Turning now to the embodiment illustrated by FIG. 2D, the rim 114 of the vessel 100 is slanted, and the oversized portion 142 extends lengthwise in accordance with the slant. In some embodiments, the slanted rim 114 facilitates pouring fluid out of the vessel 100, for example to avoid unwanted spillage. In some embodiments, the slanted rim 114 can facilitate gradual release of pressure during vessel opening, so as to avoid unwanted spewing as discussed above with reference to FIGS. 1K and 1L. For example, the slanted rim 114 can facilitate releasing pressure preferentially from a side 198 of the vessel outlet 106 during opening. In various embodiments, the slanted rim 114 can have a steeper or shallower angle than illustrated. For example, in some embodiments, the slanted rim 114 is slanted in a range of approximately 0.5 degrees to approximately 10 degrees. In some example embodiments, the slanted rim 114 is slanted in a range of approximately 0.5 degrees to approximately 30 degrees. Other ranges may be used as may be deemed appropriate for various applications.

Turning now to FIGS. 3A, 3B, 3C, 3D, 3E, 3F, 3G, and 3H, these figures further illustrate example operation and example features of the closure 110 of FIGS. 1 and 2 with utilization of a finite element analysis computer model according to some embodiments of the disclosure.

Figure 3A:
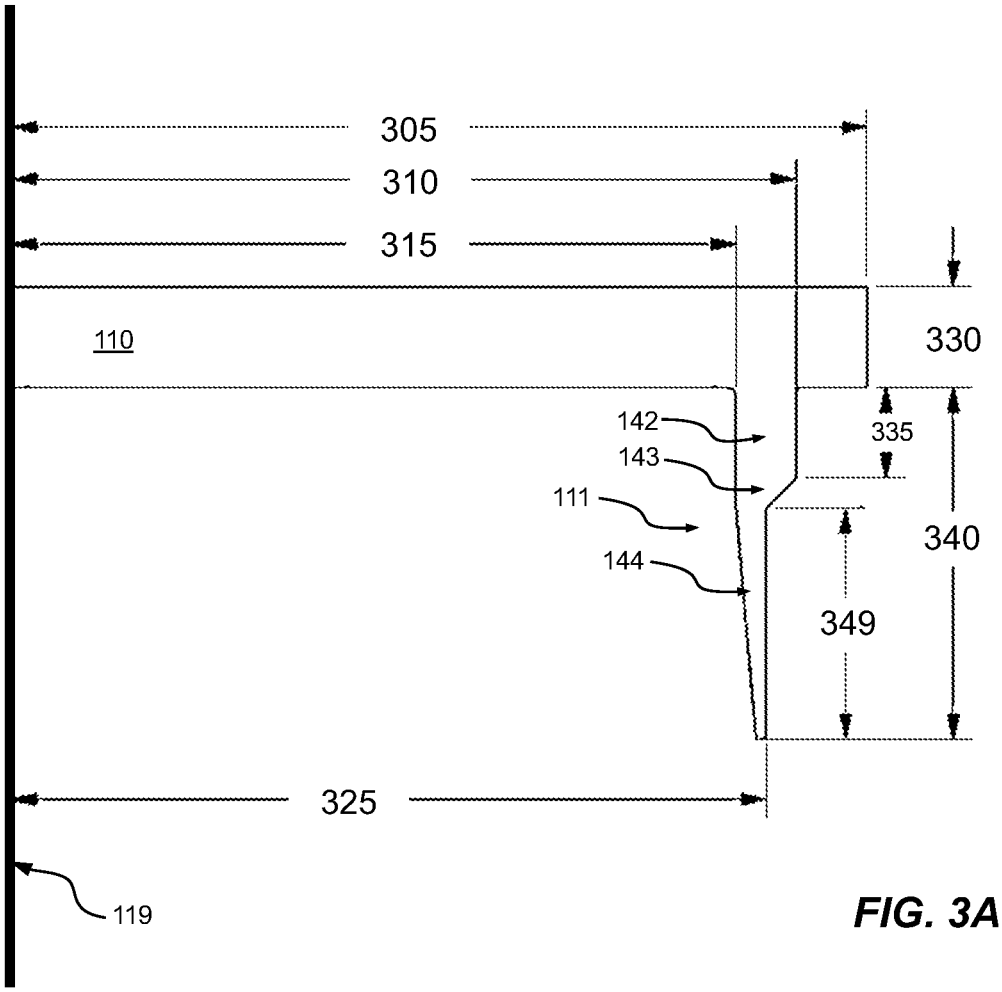
FIGS. 3A, 3B, 3C, 3D, 3E, 3F, 3G, and 3H, collectively

FIG. 3A illustrates the example closure configuration that was modeled, where certain dimensions are indicated relative to the axis 119 and thus represent radial dimensions. The modeled radial dimension 305 is 17.00 mm. The modeled radial dimension 310 is 15.60 mm. The modeled radial dimension 315 is 14.40 mm. The modeled radial dimension 325 is 15.00 mm. The modeled dimension 330 is 2.00 mm. The modeled dimension 335 is 1.80 mm. The modeled dimension 340 is 7.00 mm. The modeled dimension 349 is 4.60 mm. All these dimensions are non-limiting examples and are among many others supported by the present disclosure.

Figure 3B:
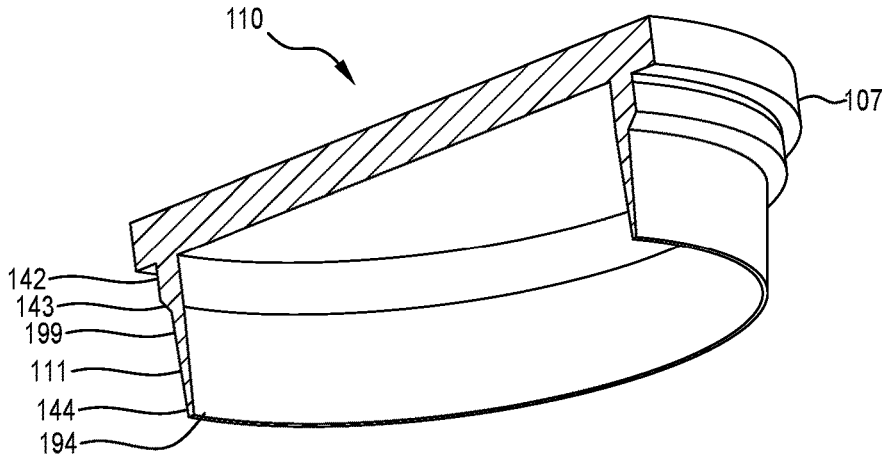

FIG. 3B illustrates a three-dimensional cutaway representation of the closure 110 as modeled and in a relaxed state, prior to stress and deformation associated with the finite element analysis.

Figure 3D:
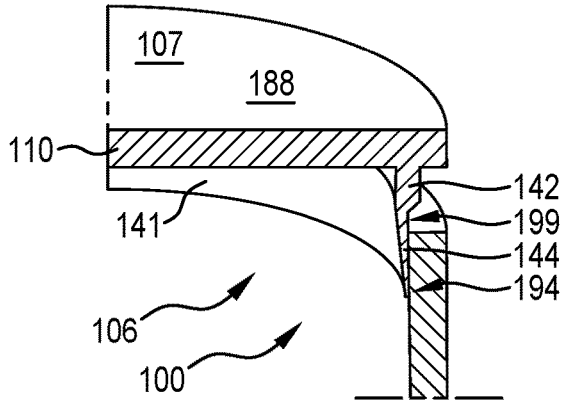
Figure 3C:
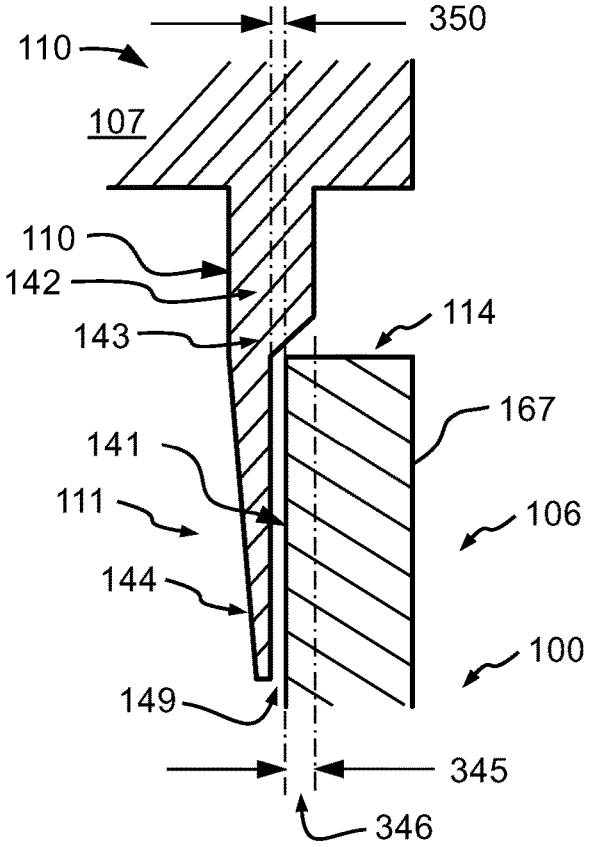

FIG. 3C illustrates an enlarged cross-sectional view of a portion of the example closure configuration modeled, with additional dimensions indicated. This figure illustrates example interference 346 between the oversized portion 142 and the interior surface 141 of the mouth 167, with the interference having an example dimension 345. The illustrated interference 346 shows diametrical oversizing of the oversized portion 142 relative to the interior surface 141 of the mouth 167, whereby the interior surface 141 exerts radial compressive force on the oversized portion 142 when the oversized portion 142 is disposed in the mouth 167 adjoining the interior surface 141. The example value used in the model for the dimension 345 of the interference 346 was 0.60 mm. FIG. 3C further illustrates an annular space 149 between the undersized male portion 144 and the interior surface 141 of the mouth 167, with the annular space 149 having a dimension 350. The example value used in the model for the dimension 350 of the annular space 149 was 0.00 mm. In other words, the model assumed that no annular space existed.

The model used glass, with a Young's Modulus of 75 GPa, as the material of the vessel 100. The model used HDPE, with a Young's Modulus of 0.8 GPa, as the material of the closure 110. The material selections represent non-limiting example among numerous others supported by the present disclosure.

Figure 3E:
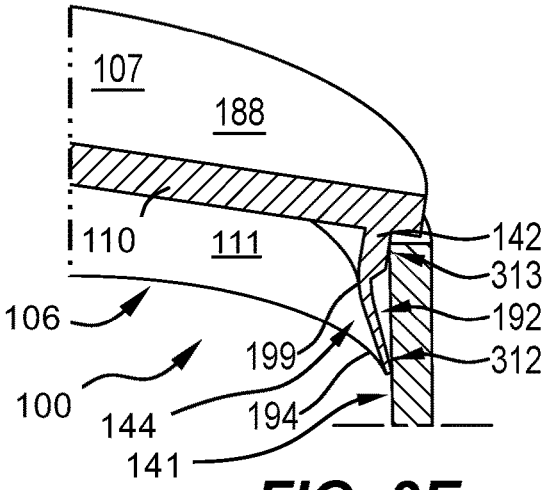

FIGS. 3D and 3E illustrate three-dimensional cutaway views of two representative stages of the closure 110 closing the vessel 100. FIG. 3D illustrates a stage of closing in which the male portion 111 is partially inserted into the vessel outlet 106, with the undersized portion 144 extending into the vessel 100. FIG. 3E illustrates a later stage of closing in which the male portion 111 is inserted to a level that the oversized portion 142 is disposed in the vessel outlet 106. The resulting interference 346 (see FIG. 3C) produces forces and deformation of the closure 110. The forces and deformation cause a distal portion 194 of the undersized portion 144 of the closure 110 to press radially outward against the interior surface 141 of the vessel outlet 106. As further described below with reference to FIG. 3H, the resulting force between the distal portion 194 and the interior surface 141 can provide a robust seal and/or a self-energizing seal 312. With the interior surface 141 of the vessel outlet 106 constraining the distal portion 194 from flaring radially outward, the forces cause a proximal portion 199 of the undersized portion 144 to bow radially inward. The bowing inward produces the enclosed gap 192, with the enclosed gap 192 disposed between the self-energizing seal 312 and a secondary seal 313. As illustrated, the forces further cause the base 107 of the closure to bulge outward, so that the outer surface 188 transitions from substantially flat to convex.

Figure 3F:
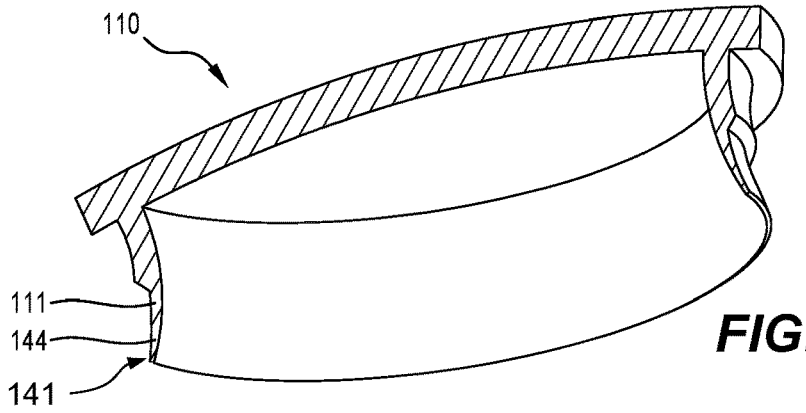
Figure 3H:
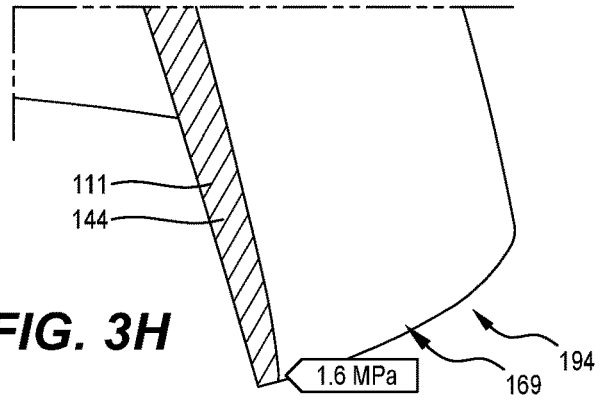
Figure 3G:
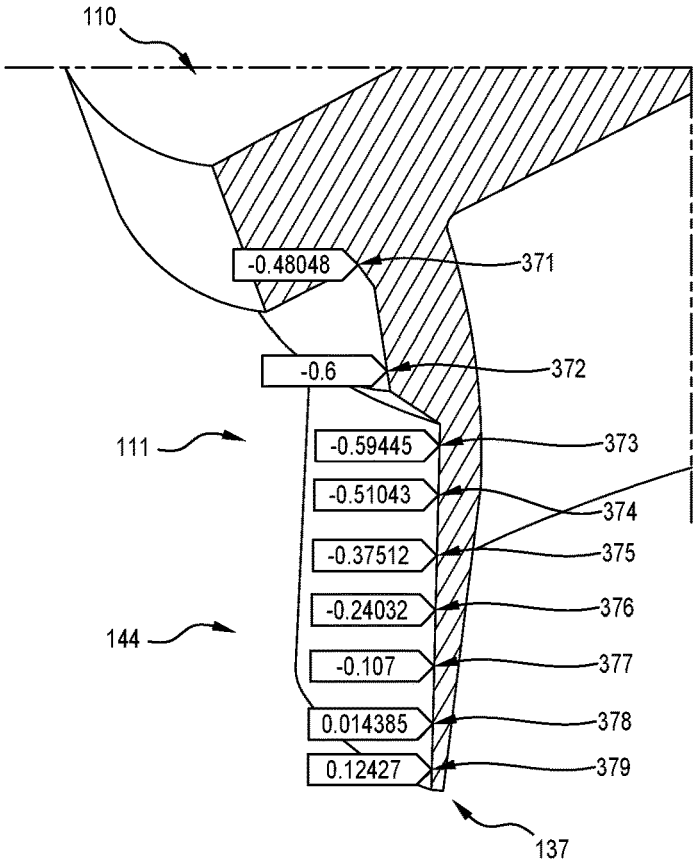

FIGS. 3F and 3G illustrate output of the computer model in which a three-dimensional cutaway view is overlaid with computed displacement data. The model computed radial displacement of the flared out portion 137 of the male portion 111 with the oversized portion 142 inserted into the vessel outlet 106 as illustrated in FIG. 3E while allowing the male portion 111 to flare out without constraint. Thus, the model allowed the undersized portion 144 to flare out without constraint by the interior surface 141 of the mouth 167 of the vessel 100. FIG. 3G shows computed values of displacement in millimeters, where negative values indicate radially inward displacement and positive values indicate radially outward displacement As illustrated, the region 371 was displaced −0.48048 mm; the region 372 was displaced −0.6 mm; the region 373 was displaced −0.59445 mm; the region 374 was displaced −0.51043 mm; the region 375 was displaced −0.37512 mm; the region 376 was displaced −0.24032 mm; the region 377 was displaced −0.107 mm; the region 378 was displaced 0.014385 mm; and the region 379 was displaced 0.12427 mm.

FIG. 3H illustrates a three-dimensional cutaway view of the closure 110 that magnifies the male portion 111 and further illustrates finite element modeling results. As discussed above, FIGS. 3F and 3G illustrate results of the finite element model allowing the male portion 111 to flare out without constraint by the interior surface 141 of the mouth 167 of the vessel 100. FIG. 3H, meanwhile, illustrates modeling results in which the interior surface 141 (shown in FIGS. 3C, 3D, and 3E) constrains the male portion 111. In particular, FIG. 3H illustrates a contact region 169 where the distal portion 194 of the male portion 111 presses against the interior surface 141 as shown in the bottom right area of FIG. 3E. The finite element model computes the pressure between the contact region 169 and the interior surface 141 of the mouth 167 of the vessel 100 as 1.6 MPa. Accordingly, a robust seal is provided.

Figure 4A:
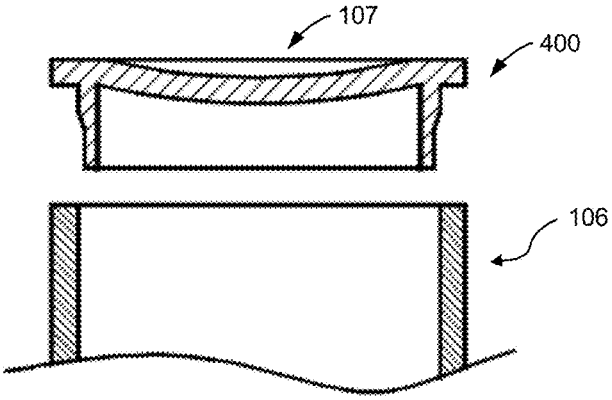
FIGS. 4A and 4B, collectively
Figure 4B:
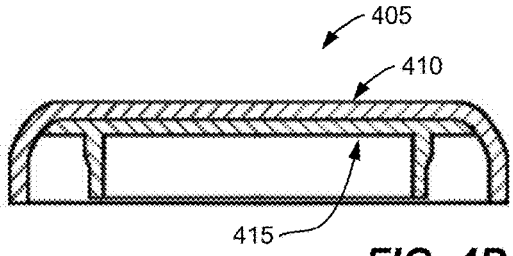

Turning now to FIGS. 4A and 4B, two other example embodiments are illustrated. As illustrated, the closure 400 of FIG. 4A and the closure 405 of FIG. 4B comprise sealing features in keeping with the features illustrated in FIGS. 2 and 3 and described in associated text. In various embodiments, the closures 400, 405 can comprise other appropriate sealing features and elements supported by the present disclosure.

FIG. 4A illustrates an example closure 400 and example associated vessel outlet 106 according to some embodiments of the disclosure. In the example of FIG. 4A, which provides a cross sectional view, the base 107 of the closure 400 arches towards the vessel outlet 106 to provide increased strength while conserving material. This closure form can counteract the bulging outward illustrated FIG. 3E and discussed above with reference to that figures.

In the example embodiment of FIG. 4B, the closure 405 comprises a metallic cover 410 in which a plastic element 415 that comprises sealing features is disposed. The metallic cover 410 can enhance structural support so that the plastic element 415 can be made relatively thin.

Figure 5:
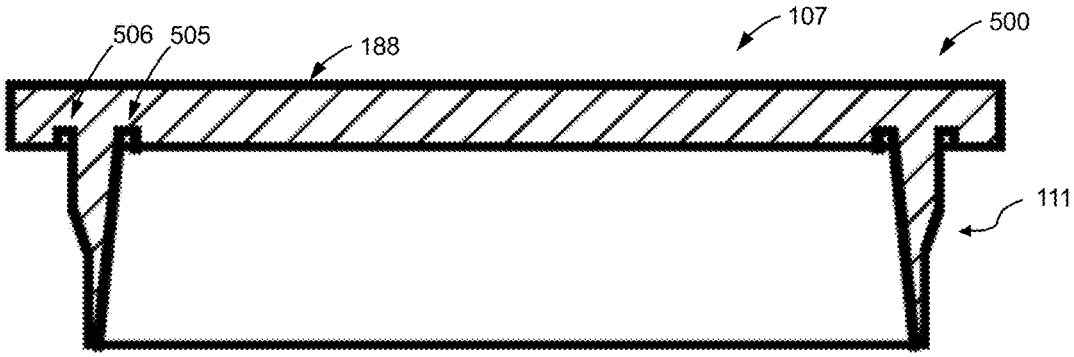
FIG. 5 is an illustration of another closure in accordance with some example embodiments of the disclosure.

Turning now to FIG. 5, this figure illustrates another example closure 500 according to some embodiments of the disclosure. In the example of FIG. 5, which provides a cross sectional view, the base 107 of the closure 500 comprises an inner groove 505 and an outer groove 506. In a view from below (not shown, orthogonal to the view of FIG. 5), the grooves 505, 506 appear as concentric circles, with the inner groove 505 having smaller diameter than the outer groove 506. In operation, the grooves 505, 506 can promote flex of the male portion 111. Accordingly, the grooves 505, 506 can facilitate sealing in appropriate applications, for example in applications warranting the use of materials that may otherwise resist flexing. The grooves 505, 506 can additionally reduce stress on the base 107 that can produce bulging of the outer surface 188 of the base 107, which is illustrated in FIG. 3E and discussed above. Thus, the grooves 505, 506 can be utilized for applications in which flatness of the outer surface 188 is desired.

As illustrated, the male portion 111 of the closure 500 comprises closure features in keeping with the features illustrated in FIG. 2 and described in associated text. In various embodiments, the closure 500 can comprise other appropriate closure features and elements supported by the present disclosure.

Turning now to FIG. 6, this figures illustrates another example closure 600 and example associated vessel outlet 106 according to some embodiments of the disclosure. In the example of FIG. 6, which provides a cross sectional view, the outlet 106 of the vessel 100 comprises a rim 114 and a first internal surface 602 of a first diameter adjacent the rim 114. The vessel outlet 106 further comprises a second internal surface 604 that is displaced longitudinally from the first internal surface 602 and is of a second diameter. The vessel outlet 106 further comprises a third internal surface 606 that is disposed between the first internal surface 602 and the second internal surface 604. As illustrated, the third internal surface 606 tapers upward in diameter between the first internal surface 602 and the second internal surface and adjoins and connects the first and second internal surfaces 602, 604.

In the illustrated example, the closure 600 comprises a male portion 111 that comprises a projection 615 oriented diametrically outward. The projection 615 comprises a portion 614 of consistent diameter and a tapered portion 616. The projection 615 is disposed between a first cylindrical surface 612 and a second cylindrical surface 613, with the first cylindrical surface 612 disposed between the projection and the base 107. In the illustrated example, the first and second cylindrical surfaces 612, 613 are of equal diameters. Other embodiments may have different diameters or geometries.

In operation, when the male portion 111 enters the vessel outlet 106 to a sufficient depth, deflection of the male portion 111 occurs as the tapered portion 616 of the projection 615 contacts and presses against the tapered third surface 606 within the vessel outlet 106. This deflection results in the closure 600 sealing the vessel outlet 106.

Figure 7A:
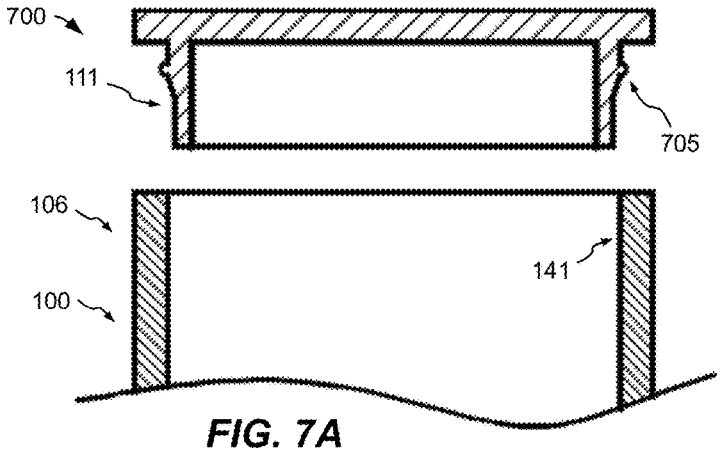
FIGS. 7A, 7B, 7C, 7D, and 7E, collectively
Figure 7B:
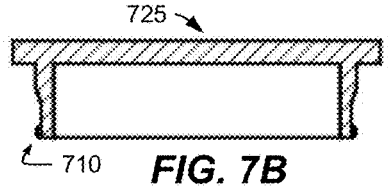
Figure 7C:
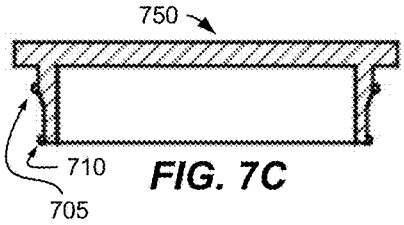
Figure 7D:
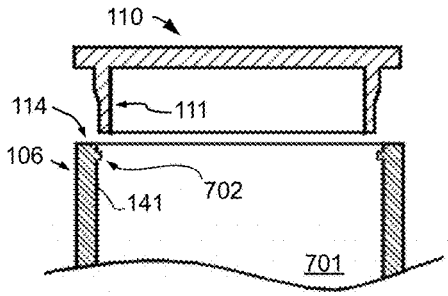
Figure 7E:
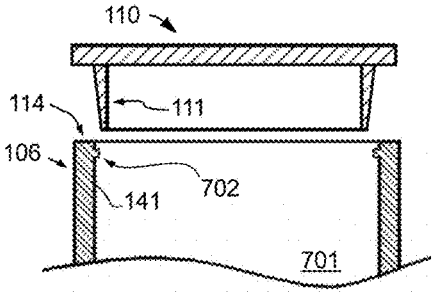

Turning now to FIGS. 7A, 7B, 7C, 7D, and 7E, additional example embodiments are illustrated. FIG. 7A illustrates an example closure 700 and an example associated outlet 106 of a vessel 100 according to some embodiments of the disclosure. In the example of FIG. 7A, which provides a cross sectional view, a male portion 111 of the closure 500 comprises a projection 705. In the illustrated embodiment, when viewed in cross sections, the projection 705 comprises a convex outline. In various embodiments, the projection 705 can be disposed at different locations on the male portion 111, for example as illustrated by FIG. 7B and discussed below.

In operation, the projection 705 can increase lateral force applied to the male portion 111 associated with insertion in the vessel outlet 106. Accordingly, the projection 705 can promote flex of the male portion 111. Thus, the projection 705 can facilitate sealing in appropriate applications, for example in applications calling for materials that may otherwise resist flexing. Additionally, the projection 705 can support or enhance a secondary seal by forming a narrow band of pressure between the male portion 111 and the interior surface 141 of the vessel outlet 106, with the pressure band disposed adjacent the base 107 in the embodiment of FIG. 7A.

As illustrated by FIG. 7A, the projection 705 is applied to the male portion 111 of the closure 500 that comprises a profile in keeping with the features illustrated in FIG. 2 and described in associated text. In various embodiments, the projection 705 can be applied to other appropriate closure features and elements supported by the present disclosure.

In the embodiment that FIG. 7B illustrates, a projection 710 is disposed distally on the male portion 111. In this location, the projection 710 can promote sealing by forming a narrow band of concentrated pressure to seal against the interior surface 141 of the vessel outlet 106 (illustrated by FIG. 7A). In some example embodiments, the projection 710 can comprise an elastomer, for example synthetic rubber or silicone, and can be disposed so as to comprise the contact region 169 illustrated in FIG. 3H and discussed above. For example, the elastomer can be fused to a thermoplastic of the male portion during molding or via another appropriate process. In some example embodiments, the projection 710 and the remainder of the male portion 111 are formed of a common material, for example a thermoplastic. In various example embodiments, the projection 710 can comprise a convex outline.

In the embodiment that FIG. 7C illustrates, the male portion 111 comprises the projection 705 and the projection 710, as respectively illustrated by FIGS. 7A and 7B as discussed above. In this embodiment, the projection 705 can provide one or more effects discussed above with reference to FIG. 7A and the projection 710 can provide one or more effects discussed above with reference to FIG. 7B.

In the example embodiment that FIG. 7D illustrates, a vessel 701 has an outlet 106 with an interior surface 141 that comprises a projection 702 adjacent the rim 114. As illustrated, the vessel's closure 110 is consistent with the closure 110 illustrated by FIGS. 2A, 2B, and 2C and the foregoing associated discussion. Thus in some example embodiments, the closure 110 that FIGS. 2A, 2B, and 2C illustrate can be utilized in the embodiment of FIG. 7D. In operation, the projection 702 can produce or heighten interference between the male portion 111 and the vessel outlet 106. The produced or heightened interference can amplify flaring out of the male portion 111, which is illustrated at FIGS. 2C and 3E and discussed above, among other places herein. Amplifying flaring out of the male portion 111 can facilitate utilization of materials or dimensions that may be desired for some applications and/or promote seal enhancement. Additionally, in some example embodiments, the projection 702 can provide a secondary seal at or adjacent where the projection 702 presses against the male portion 111.

In the example embodiment that FIG. 7E illustrates, the vessel 701 has an outlet 106 with an interior surface 141 that comprises a projection 702 adjacent the rim 114. The closure 110 of FIG. 7E comprises a male portion 111 that is continuously tapered. The continuously tapered male portion 111 illustrated by FIG. 7E can comprise an oversized portion 142, a tapered portion 143, and an undersized portion 144 which FIG. 2A illustrates as discussed above.

Figure 8A:
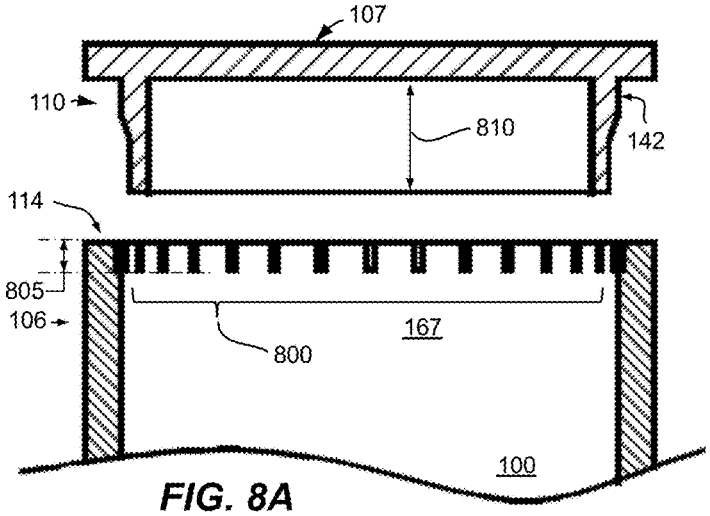
FIGS. 8A and 8B, collectively
Figure 8B:
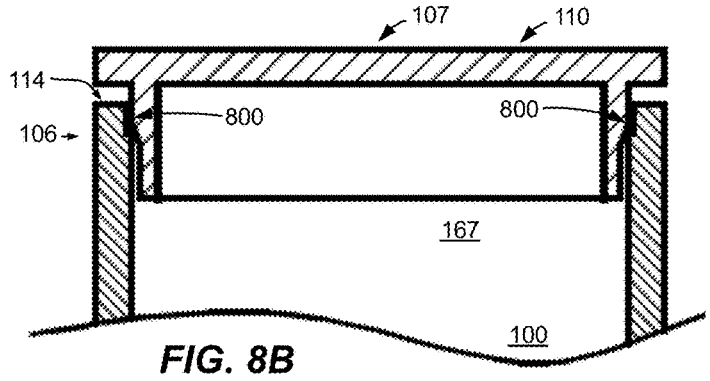

Turning now to FIGS. 8A and 8B, these figures illustrate another example closure 110 and associated vessel outlet 106 comprising example pressure venting channels 800 according to some embodiments of the disclosure. As illustrated, the pressure venting channels 800 extend inside the mouth 167 of the vessel 100 a distance 805 from the rim 114. In the illustrated example, that distance 805 is less than the distance 810 that the male portion 111 of the closure 110 extends from the base 107 of the closure 110. With this configuration, the pressure venting channels 800 can avoid interference with sealing. Additionally, in the illustrated example of FIG. 8, once the closure 110 is completely inserted into the mouth 167 of the vessel 100, the oversized portion 142 extends beyond (that is, to a greater depth in the vessel outlet 106 than) the pressure venting channels 800.

In operation as illustrated in FIG. 8B, as the closure 110 is removed from the mouth 167, pressure within the vessel 100 gradually escapes through the pressure venting channels 800, thereby avoiding unwanted spewing as may occur with carbonated beverages in conventional pressurized containers.

The pressure venting channels 800 may have different forms or geometries according to various applications and vessel configurations. In some example embodiments, the pressure venting channels 800 comprise grooves or slots formed in the interior surface of the vessel outlet 106, such as in a range of 0.1 mm to 1.0 mm in depth and in a range of 0.1 mm to 1.0 mm in width, where these ranges are nonlimiting and among others supported by the present disclosure. The pressure venting channels 800 can be spaced at various distances, for example separated by a distance in a range of 1.0 mm to 10 mm, where this range is nonlimiting and among others supported by the present disclosure.

Figure 9:
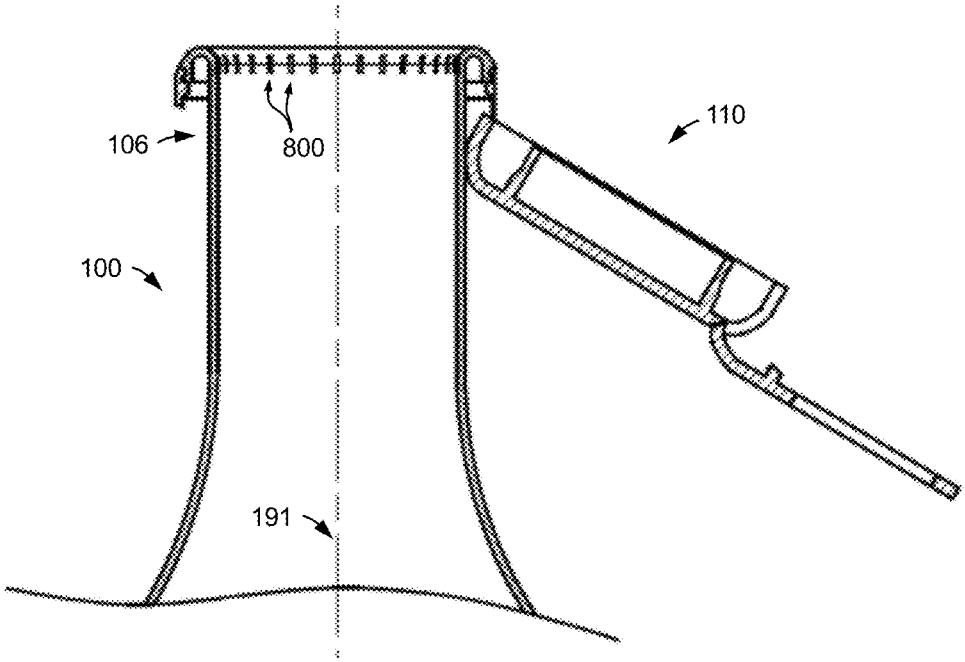
FIG. 9 is an illustration of a closure and associated vessel describing an application of pressure venting channels to the vessel illustrated in FIG. 1 in accordance with some example embodiments of the disclosure.

Turning now to FIG. 9, this figure illustrates an example closure 110 and example associated vessel 100 describing an example application of example pressure venting channels 800 to the vessel 100 illustrated in FIG. 1 according to some embodiments of the disclosure. Thus, the pressure venting channels 800 can vent pressure from a variety of vessel and closures configuration, including the embodiment illustrated in FIG. 1 and discussed above.

Figure 10:
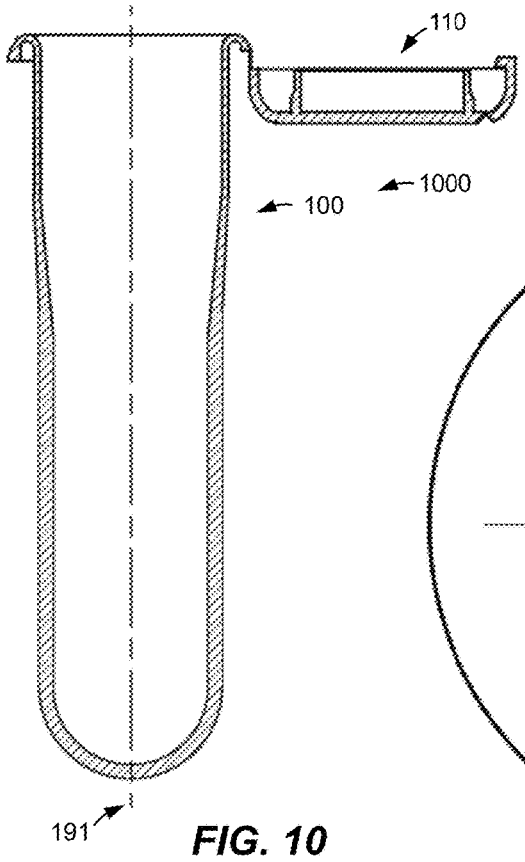
FIG. 10 is an illustration of a blow molding preform for fabricating the closure and associated vessel illustrated in FIG. 1 in accordance with some example embodiments of the disclosure.

Turning now to FIG. 10, this figure illustrates an example blow molding preform 1000 for fabricating the closure 110 and associated vessel 100 illustrated in FIG. 1 according to some embodiments of the disclosure. The preform 1000 extends lengthwise along the axis 191 and comprises the closure 110 and the vessel 100. In operation, a blow molding machine can heat the preform 1000 to soften its plastic material and then inject gas so it expands against a forming mold, thereby producing the vessel 100 and associated closure 110. In some example embodiments, the preform 1000 provides all materials for the features illustrated in FIG. 1. Thus, the blow molding operation can produce the entire vessel 100 and closure 110 as an integrated unit. Alternatively, elements can be added following blow molding.

Turning now to FIGS. 11A, 11B, 11C, 11D, 11E, 11F, 11G, 11H, and 11I, these figures illustrate another example closure 110 and example associated vessel 100 that is resealable and provides a pull ring 1100 for toting according to some embodiments of the disclosure. FIG. 11 illustrates an example pull ring configuration that provides an alternative to the example pull ring configuration illustrated in FIG. 1, discussed above. In the example embodiment illustrated by FIG. 1 (and other figures), the pull ring 121 extends longitudinally alongside the vessel outlet 106, substantially parallel with the axis 191. As further discussed below, in the example pull ring configuration illustrated by FIG. 11, the pull ring 1100 circumscribes the closure 110 and the vessel outlet 106.

Figure 11A:
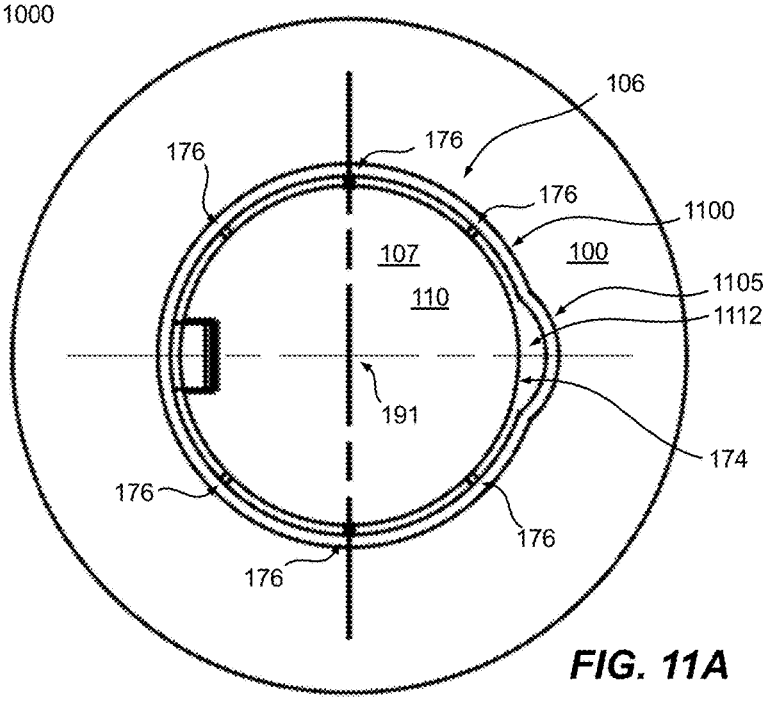
FIGS. 11A, 11B, 11C, 11D, 11E, 11F, 11G, 11H, and 11I, collectively
Figure 11B:
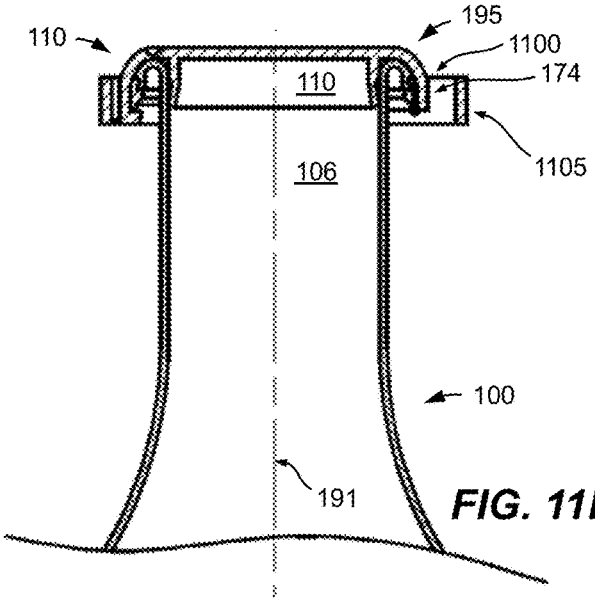
Figure 11C:
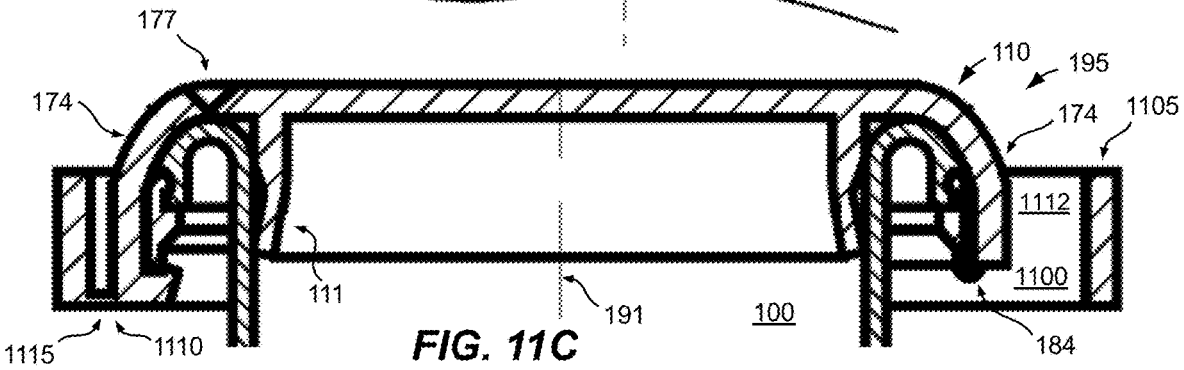

As illustrated in FIGS. 11A, 11B, and 11C, the pull ring 1100 extends around the sides 174 of the closure 110 and connects with the sides 174 at a frangible connection 176 (visible in FIG. 11A). In the illustrated example, the frangible connection 176 comprises six points or locations where the material of the pull ring 1100 continues to or fuses with the material of the closure side 174. At the opposite side of the closure 110 from a hinge 1110, the pull ring 1100 comprises an extension 1105 that creates an aperture 1112 sized to facilitate engagement or reception of a user fingertip. The hinge 1110 comprises a flexible strip of material 1115 that extends between the pull ring 1100 and the closure side 174.

In some example embodiments, the closure 110, the pull ring 1100, and the flexible strip of material 1115 comprise a unitary element that may be formed from one material. Moreover, in some embodiments, everything illustrated in FIG. 11 (FIGS. 11A, 11B, 11C, 11D, 11E, 11F, 11G, 11H, and 11I) can be one continuous, unitary element.

To open the vessel 100, the user can place his or her fingertip below the extension 1105 in the aperture 1112. The user can pull up on the pull ring 1100 so that the pull ring 1100 rotates about the hinge 1110, over the closure 110, and across the axis 191, to result in the configuration illustrated in FIG. 11D.

Figure 11D:
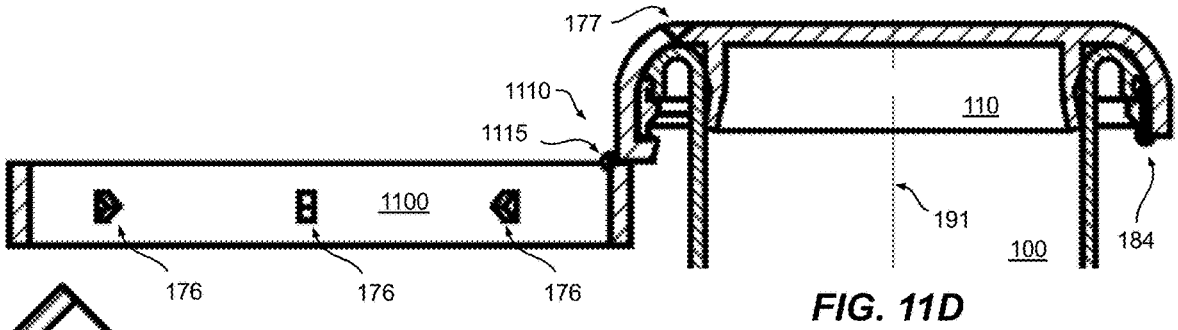
Figure 11E:
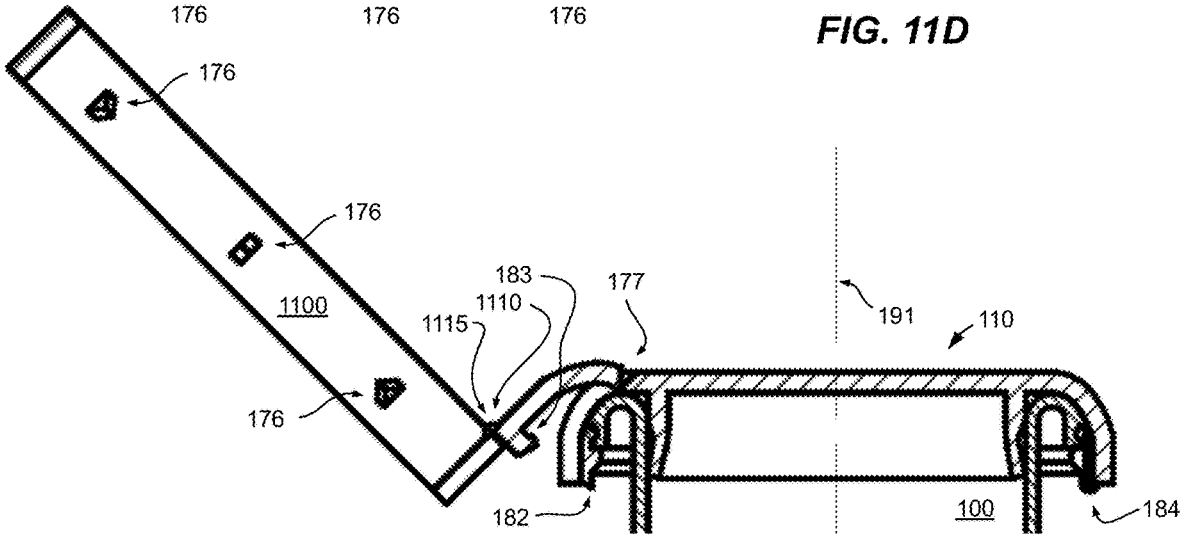
Figure 11F:
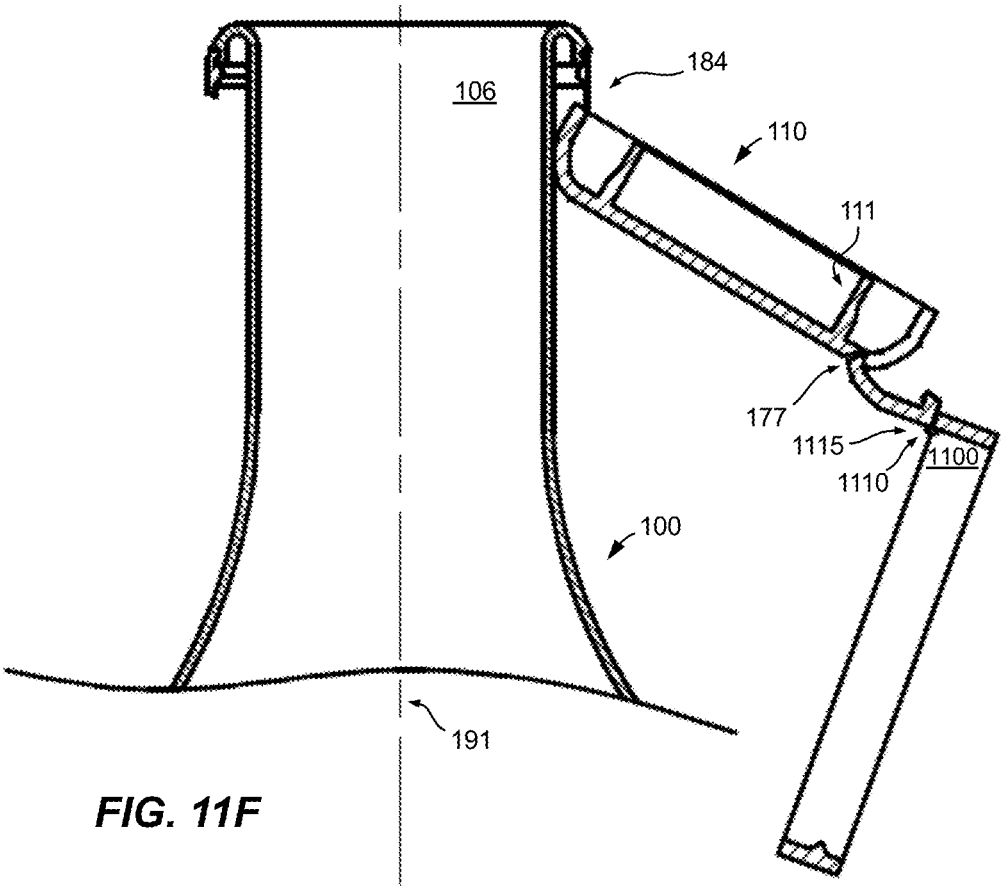

As illustrated in FIG. 11E, from the configuration illustrated in FIG. 11D, the user can pull outward and upward on the pull ring 1100 so that the projection 182 escapes from the notch 183 as discussed above with reference to FIG. 1. As illustrated in FIG. 11F, the user can then pull the pull ring 1100 across the vessel 100 to extract the male portion 111 of the closure 110 from the vessel outlet 106 and open the vessel 100 as discussed above with reference to FIG. 1.

Figure 11G:
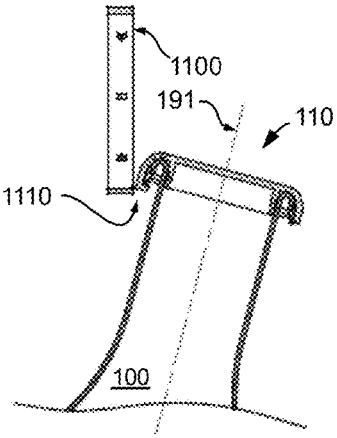
Figure 11H:
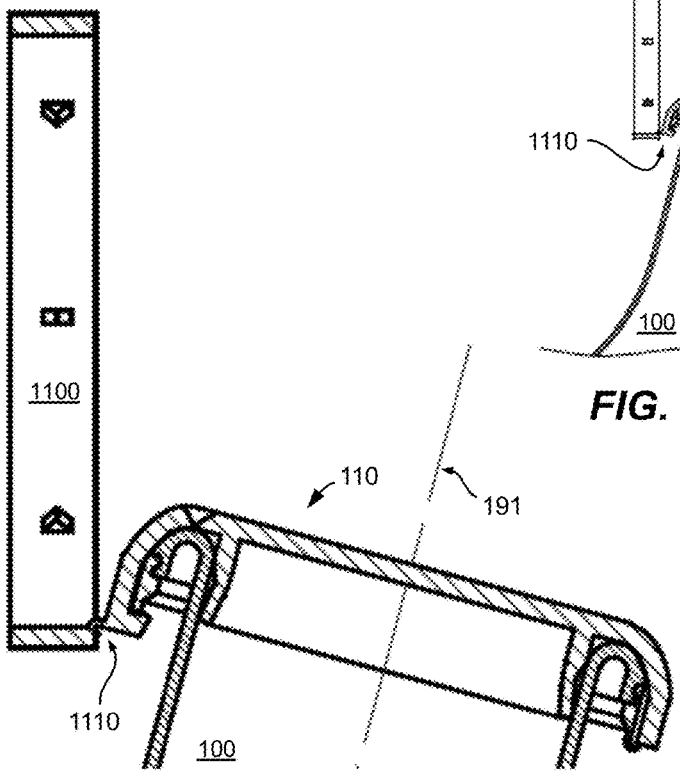
Figure 11I:
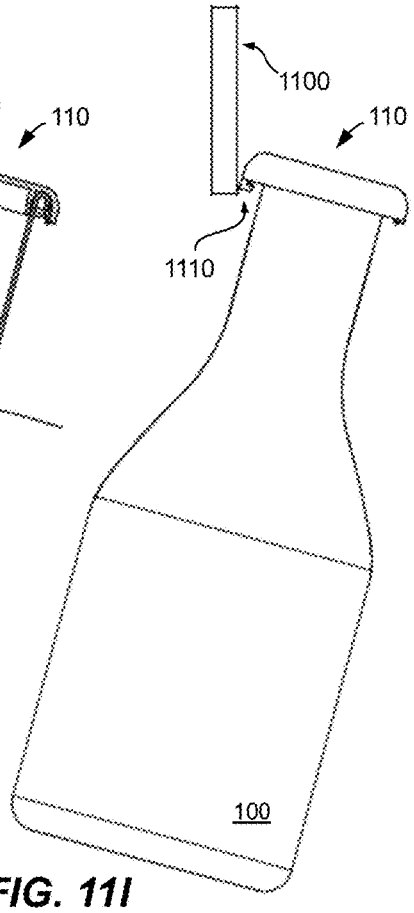

As illustrated in FIG. 11G and the magnified view of FIG. 11H, after taking a drink or otherwise using the vessel 100, the user can pull the pull ring back over the vessel 100 and reengage or reseat the projection 182 back in the notch 183 to close and reseal the vessel 100. With the resulting configuration illustrated in FIG. 11I, the user can then use the pull ring 1100 to carry by hand or to suspend the closed vessel 100 during transport. For example, the user can loop a backpack strap or cord through the pull ring 1100 or clip the pull ring 1100 to the user's belt or a bicycle with a carabiner (not illustrated).

Turning now to FIGS. 12A, 12B, 12C, and 12D, these figures illustrate another example closure 1200 and example associated vessel 100 according to some embodiments of the disclosure. In this example, the closure 1200 comprises a skirt 1205, in the example form of a flared lip, that retains and releases the closure 1200 in connection with closing and opening the vessel 100 as discussed below.

Figure 12A:
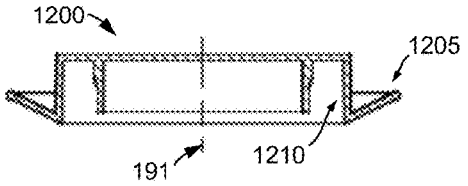
FIGS. 12A, 12B, 12C, and 12D, collectively
Figure 12C:
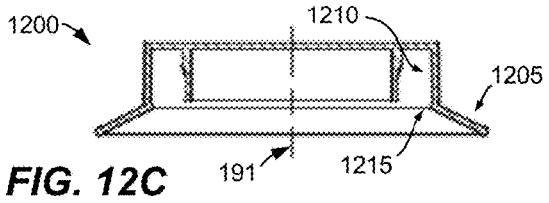
Figure 12B:
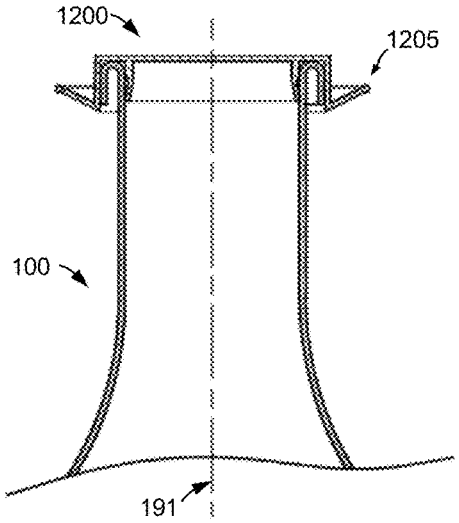
Figure 12D:
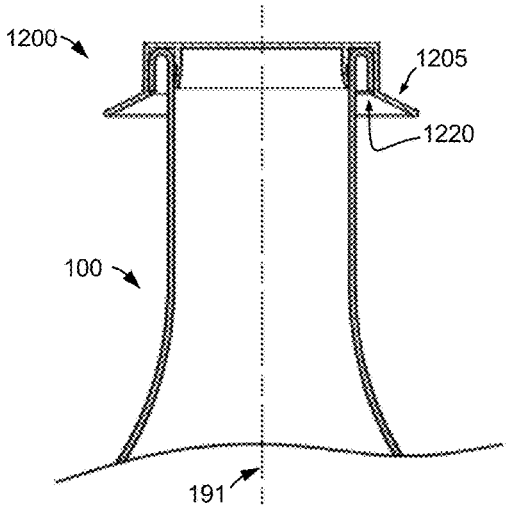

FIG. 12A illustrates a cross sectional view of the closure 1200 in an open configuration with the skirt 1205 of the closure 1200 raised. FIG. 12B illustrates a cross sectional view of the closure 1200 disposed on the vessel 100 with the closure 1200 in the open configuration and the skirt 1205 raised. FIG. 12C illustrates a cross sectional view of the closure 1200 in a closed configuration and the skirt 1205 lowered. FIG. 12D illustrates a cross sectional view of the closure 1200 disposed on the vessel 100 with the closure in the closed configuration and the skirt 1205 lowered.

With the closure 1200 in the open configuration illustrated in FIGS. 12A and 12B and the skirt 1205 raised, an inner surface 1210 of the closure 1200 is smooth and uninterrupted. Accordingly, the closure 1200 can be readily removed from or placed on the vessel 100.

With the closure 1200 in the closed configuration illustrated in FIGS. 12C and 12D and the skirt 1205 lowered, a projection 1215 projects from the inner surface 1210 of the closure 1200. As shown in FIG. 12D, the projection 1215 projects under and engages a shoulder 1220 of the vessel 100. The projection 1215 and shoulder 1220 thus form a releasable catch that facilitates closing and opening the vessel 100 repeatedly.

Figure 13:
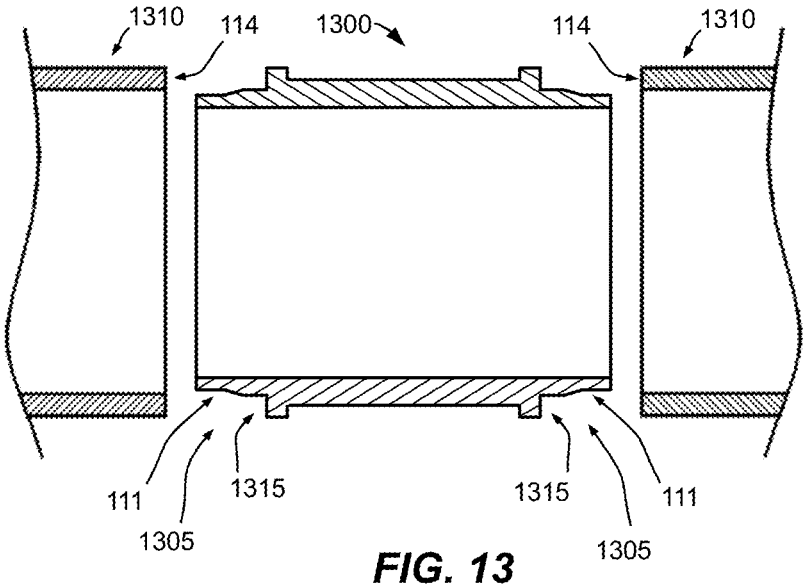
FIG. 13 is an illustration of a tubing coupler in accordance with some example embodiments of the disclosure.
Figure 14A:
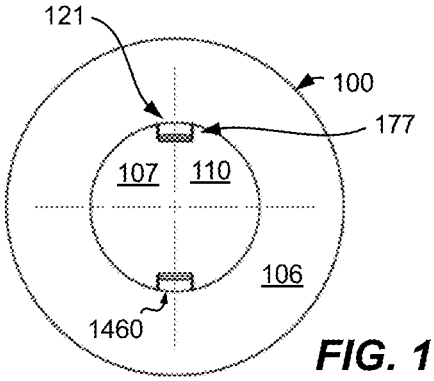
FIGS. 14A, 14B, 14C, 14D, 14E, 14F, and 14G, collectively
Figure 14B:
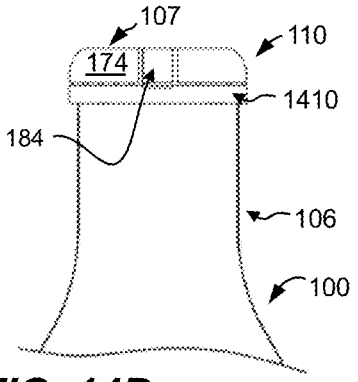
Figure 14C:
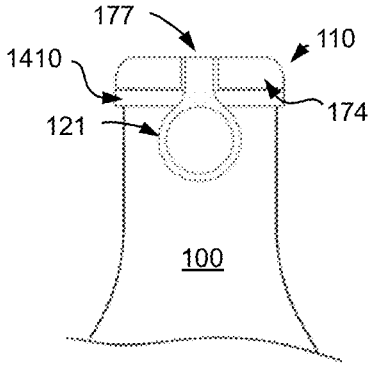
Figure 14D:
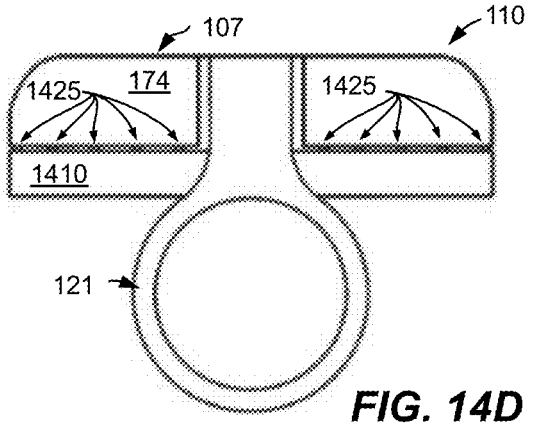
Figure 14E:
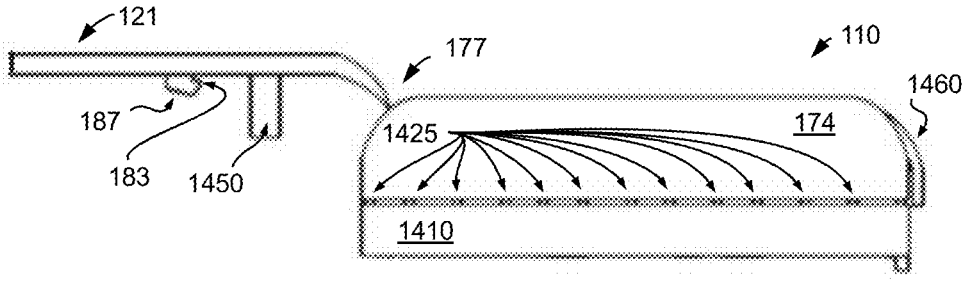
Figure 14F:
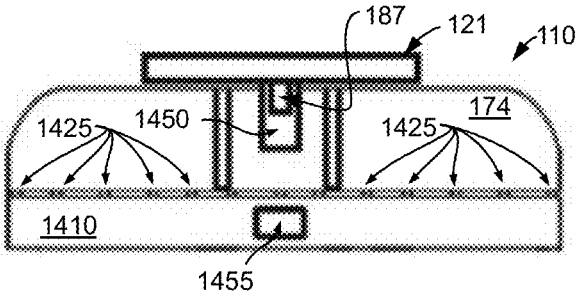
Figure 14G:
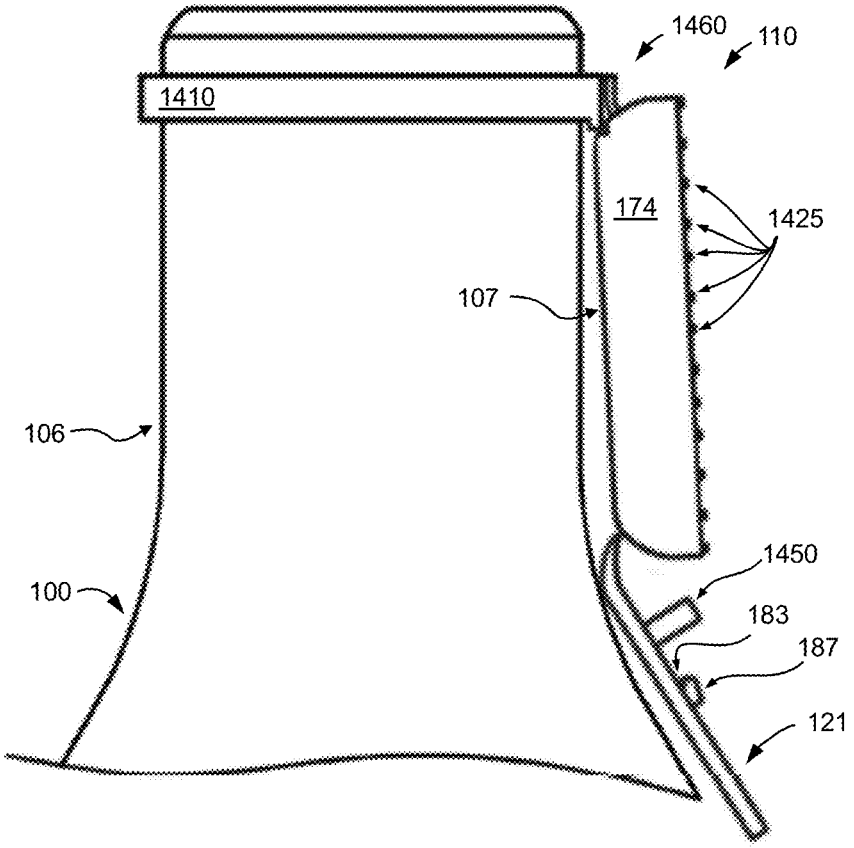

Turning now to FIG. 13, this figure illustrates an example tubing coupler 1300 according to some embodiments of the disclosure. As illustrated (in cross section), the example tubing coupler 1300 comprises two male ends 1305 each comprising male portions 111, configured and oriented for insertion in two tubes 1310. Example assembly can comprise placing the two tubes 1310 over the male ends 1305 until the tubing rims 114 butt against shoulders 1315 of the tubing coupler 1300. In some applications, it may be appropriate to retain the tubes 1310 in this position using one or more retainers (not illustrated), such as a clasps, fasteners, nuts and bolts, threads, bands, clips, hooks, buckles, brackets, or other appropriate retaining apparatus.

In the illustration of FIG. 13, the tubes 1310 comprise an example embodiment of a vessel, and the tubing coupler 1300 comprises an embodiment of a closure. The illustrated example tubing coupler 1300 comprises closure features in keeping with the features illustrated in FIG. 2 and described in associated text. In various embodiments, the tubing coupler 1300 can incorporate other appropriate closure features and elements supported by the present disclosure.

Turning now to FIGS. 14A, 14B, 14C, 14D, 14E, 14F, and 14G, these figures illustrate another example closure 110 and example associated vessel 100 according to some embodiments of the disclosure. The example embodiment of FIG. 14 can accommodate the sealing features of the embodiment of FIG. 1, which illustrates the male portion 111 sealing against an interior surface 141 as discussed above. The embodiment that FIG. 14 illustrates can further accommodate other sealing technologies and means. While FIG. 14 will be discussed below with reference to certain corresponding features of FIG. 1, the illustrated features of the closure 110 of FIG. 14 have applicability beyond the example seal illustrated at FIG. 1.

The closure 110 of FIG. 14 comprises a band 1410 that circumscribes the vessel outlet 106. In some example embodiments, the band 1410 can attach to the vessel 110 in keeping with the attachment of the band 181 illustrated in FIG. 1 and discussed above. In some example embodiments, the band 1410 can be seated in a groove formed in or adjacent to the vessel outlet 106 (not illustrated in FIG. 14).

A base 107 of the closure 110 attaches to the band 1410 via a frangible connection that comprises an array of frangible connection points 1425 extending circumferentially and extending between the band 1410 and the closure side 174. The base 107 further attaches to the band 1410 via a hinge 1460. In some example embodiments, the hinge 1460 can comprise the hinge 184 as illustrated in FIG. 1 and/or FIG. 11 and as discussed above.

A pull ring 121 attaches to the base 107 via a hinge 177 in accordance with the hinge 177 illustrated in FIG. 1 and discussed above. The pull ring 121 operates from the user's perspective like the pull ring 121 illustrated in FIG. 1 and discussed above. When the user pulls the pull ring to open the vessel 100, the frangible connection points 1425 sever, the base 107 moves away from the band 140 with the hinge 1460 maintaining an attachment between the base 107 and the band 1410, and the vessel 100 opens.

In addition to the frangible connection, the base attaches to the band 1410 via a catch that comprises a projection 187 with a notch 183 on the pull ring 121 and a projection 182 (shown in FIG. 1) that seats in the notch. As discussed above with reference to FIG. 1, when the user pulls the pull ring, the catch releases. In the example embodiment of FIG. 14, a second catch provides additional holding security. The second catch comprises a member 1450 that projects from the pull ring 121. The member 1450 extends from the pull ring 121 into an aperture 1455 in the band 1410. In the illustrated example embodiment, the member 1450 and the aperture 1455 have rectangular cross sections and the member 1450 mates with the aperture 1455. The member 1450 is sized and shaped in accordance with the aperture 1455. When the user pulls the pull ring 121 to open the vessel 100, the member 1450 extracts from the aperture 1455 to release the base 107 from the band 1410. Accordingly, the two catches of the embodiment of FIG. 11 can help avoid inadvertent vessel opening and help accommodate high pressures.

Figure 15:
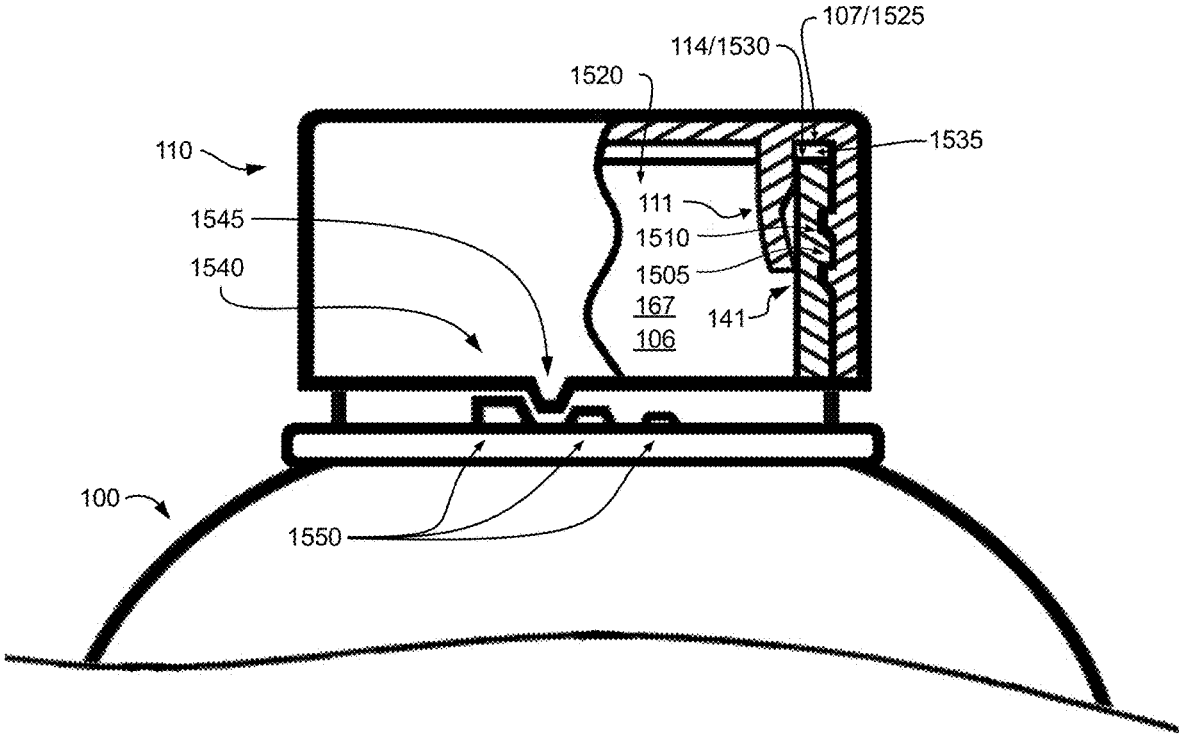
FIG. 15 is an illustration of another closure and associated vessel in accordance with some example embodiments of the disclosure.

Turning now to FIG. 15 this figure illustrates another example closure 110 and example associated vessel 100 according to some embodiments of the disclosure. As further discussed below, in the example that FIG. 15 illustrates, a threaded retention system retains the closure 110 on the vessel 100. The closure 110 can comprise a bottlecap in some example embodiments and will be referred to as such below, without limitation. The vessel 100 can comprise a drink bottle in some example embodiments and will be referred to as such below, without limitation.

In the example embodiment of FIG. 15, the outlet 106 of the drink bottle 100 comprises male threads 1505, and the bottlecap 110 comprises female threads 1510. That is, the outlet 106 and the bottlecap 110 comprise corresponding threads 1505, 1510, with the outlet 106 configured for insertion into a threaded recess 1520 of the bottlecap 110. In various embodiments, the threads 1505, 1510 may comprise conventional or nonconventional features.

In the illustrated embodiment of FIG. 15, the sealing system illustrated by FIGS. 2A, 2B, and 2C is incorporated so that the bottlecap 110 seals and further screws on and screws off. In this embodiment, unscrewing the bottlecap 110 progressively extracts the male portion 111 from the mouth 167 of the outlet 106 to open the drink bottle 100, while screwing the bottlecap 110 on progressively inserts the male portion 111 into the outlet 106 for sealing. The male portion 111 and the interior surface 141 of the outlet 106 thus form a seal that can travel up and down the interior surface 141 of the outlet 106. Accordingly, the screw-on bottlecap 110 can achieve sealing without necessarily requiring a strong compressive force between a surface 1525 on the base 107 of the bottlecap 110 and the top face 1530 of an outlet rim 114. The illustrated seal can thus avoid binding or jamming that may occur with conventional screw-on closures on drink bottles and that may cause unscrewing difficulties associated with axial compressive binding. More particularly, as illustrated by example FIG. 15, when the drink bottle 100 is fully closed and sealed, a gap 1535 can exist between the rim 114 of the outlet 106 and the base 107 of the bottlecap 110. The gap 1535 can help avoid binding that may be associated with forming a seal between two surfaces using excessive compressive axial forces, i.e. compression along the axis 191 (see FIG. 1M).

In the illustrated example embodiment of FIG. 15, a stop 1540 provides the gap 1535 (or may otherwise control force between the rim 114 and the base 107) by impeding, checking, blocking, or obstructing screwing on the bottlecap 110 beyond a predetermined number of rotations or beyond a predetermined axial distance. The illustrated stop 1540 comprises a projection 1545 extending from the bottlecap 110 and a series of progressively larger projections 1550 extending from the drink bottle 100. When a user screws the bottlecap 110 on to predetermined level, the bottlecap projection 1545 encounters and interacts with the progressively larger bottle projections 1550. As the user screws down the bottlecap 110, the bottlecap projection 1545 ratchets past the progressively larger bottle projections 1550. For tactile feedback, the user applies a progressively increasing amount of torque or rotational force to overcome each of the progressively larger bottle projections 1550. Once the largest of the progressively larger bottle projections 1550 is encountered, further rotation is obstructed and the bottlecap

1545 screwing on is complete. Accordingly, a system of projections or lugs can provide screwing impediment or friction that increases progressively and/or in a stepwise matter to provide controlled resistance that a user can perceive via tactile feedback while screwing on the bottlecap 110, for example.

In some example embodiments, the stop 145 can comprise at least one shoulder that provides a physical stop point or one or more projections or lugs that prevent overtightening by obstructing rotation past a predetermined point. In some example embodiments, the stop 145 can comprise a series of projections or lugs that ratchet with corresponding grooves (not illustrated) which extend in an axial direction through one or both of the threads 1505, 1510.

Useful closure technology has been described. From the description, it will be appreciated that an embodiment of the disclosure overcomes limitations of the prior art. Those skilled in the art will appreciate that the technology is not limited to any specifically discussed application or implementation and that the embodiments described herein are illustrative and not restrictive. Furthermore, the particular features, structures, or characteristics that are set forth may be combined in any suitable manner in one or more embodiments based on this disclosure and ordinary skill. Those of ordinary skill having benefit of this disclosure can make, use, and practice a wide range of embodiments via combining the disclosed features and elements in many permutations without undue experimentation and further by combining the disclosed features and elements with what is well known in the art. This disclosure not only includes the illustrated and described embodiments, but also provides a rich and detailed roadmap for creating many additional embodiments using the various disclosed technologies, elements, features, their equivalents, and what is well known in the art. From the description of the example embodiments, equivalents of the elements shown herein will suggest themselves to those skilled in the art, and ways of constructing other embodiments will appear to practitioners of the art. Therefore, the scope of the technology is to be limited only by the appended claims.

What is claimed is:

1. An apparatus comprising:

a vessel comprising an outlet that comprises:

a rim; and a first cavity that extends from the rim and comprises an interior surface comprising an inner diameter; and a closure comprising:

a base portion; and a male portion that extends from the base portion to form a second cavity and that comprises:

a first portion that extends circumferentially about the second cavity and has a first outer diameter that is larger than the inner diameter when the closure is in a relaxed state, said relaxed state comprising the apparatus in an open configuration with the male portion disposed outside the first cavity;

a second portion that extends circumferentially about the second cavity and has a second outer diameter that is no larger than the inner diameter when the closure is in said relaxed state; and a third portion that extends circumferentially about the second cavity, is tapered, and is disposed between the first portion and the second portion, wherein the first portion is disposed between the third portion and the base portion, and wherein the closure is dimensioned so that when the male portion is inserted in the first cavity with the base portion adjoining the rim, the interior surface of the vessel applies radial compressive force to the first portion that causes the second portion to flare out relative to said relaxed state, said flare out comprising diametrical expansion of the second portion relative to said second outer diameter, said diametrical expansion producing lateral force between the second portion and the interior surface causing the second portion to engage the interior surface and produce a self-energizing seal.

2. The apparatus of claim 1, wherein the inner diameter is larger than the second outer diameter when the closure is in said relaxed state, and wherein the interior surface comprises a circumferentially extending projection that is disposed adjacent the rim.

3. The apparatus of claim 1, wherein the male portion is disposed in the first cavity with the base portion adjoining the rim, wherein as a result of said interference, the second portion flares out, engages the interior surface, and produces said self-energizing seal, and wherein the interior surface, the second portion, and the third portion form an enclosed space that extends circumferentially about the second cavity.

4. The apparatus of claim 1, wherein the male portion comprises a continuous taper that comprises the first portion, the second portion, and the third portion.

5. The apparatus of claim 1, wherein both the vessel and the closure are formed together, integrally, of a single piece of material with a composition comprising a common polymer.

6. The apparatus of claim 1, wherein the interior surface of the first cavity comprises pressure venting channels adjacent the rim.

7. The apparatus of claim 1, wherein the rim comprises a curved contour, wherein with the apparatus in a closed configuration with the male portion extending into the first cavity, the apparatus further comprises the self-energizing seal, wherein the self-energizing seal comprises an enclosed gap formed between the male portion and the interior surface, and wherein the curved contour and the enclosed gap comprise a pressure venting path.

8. The apparatus of claim 1, wherein the closure and the vessel are arranged so that the male portion extends into the first cavity, with the first portion, the second portion, and the third portion disposed in the first cavity, wherein the male portion and the interior surface form the self-energizing seal, a second seal, and an enclosed gap, and wherein the enclosed gap is disposed between the self-energizing seal and the second seal.

9. The apparatus of claim 1, wherein the vessel is formed of a first unitary piece of material of a composition comprising a polymer, and wherein the closure is formed of a second unitary piece of material of the composition comprising the polymer.

10. The apparatus of claim 1, wherein each of the vessel and the closure comprises polyethylene terephthalate.

11. The apparatus of claim 1, wherein the vessel and the closure are composed of polyethylene terephthalate.

12. The apparatus of claim 1, wherein the first portion adjoins the base.

13. The apparatus of claim 12, wherein the third portion adjoins the first portion.

14. The apparatus of claim 13, wherein the second portion adjoins the third portion.

15. The apparatus of claim 1, wherein a distal portion of the second portion comprises said self-energizing seal, wherein the first portion extends along an axis of the apparatus away from the base and to the third portion, wherein the third portion extends along the axis, from the first portion to the second portion, and wherein the second portion extends along the axis, from the third portion to the distal portion.

16. The apparatus of claim 1, wherein each of the vessel and the closure comprises polyethylene terephthalate, wherein in the closed configuration, the male portion and the interior surface form the self-energizing seal, a second seal, and an enclosed gap, and wherein the enclosed gap is disposed between the self-energizing seal and the second seal.

17. An apparatus comprising:

a vessel comprising an outlet that comprises:

a rim; and a first cavity that extends from the rim and comprises an interior surface comprising an inner diameter;

a closure comprising:

a base portion; and a male portion that extends from the base portion to form a second cavity and that comprises:

a first portion that extends circumferentially about the second cavity;

a second portion that extends circumferentially about the second cavity; and a third portion that extends circumferentially about the second cavity, is tapered, and is disposed between the first portion and the second portion;

a closed configuration in which each of the first portion, the second portion, and the third portion extends into the first cavity; and an open configuration in which each of the first portion, the second portion, and the third portion is disposed outside the first cavity, wherein in the open configuration, the first portion has a first outer diameter that is larger than the inner diameter and the second portion has a second outer diameter that is no larger than the inner diameter, and wherein in the closed configuration, the interior surface of the outlet diametrically compresses the first portion, produces radial compressive forces and deformation, and causes the first portion to have a third outer diameter that is smaller than the first outer diameter, wherein said radial compressive forces and deformation cause the second portion to press radially outward against the interior surface and form a self-energizing seal.

18. The apparatus of claim 17, wherein in the open configuration, the second outer diameter is smaller than the inner diameter, and wherein in the closed configuration, the second portion has a fourth outer diameter that comprises the inner diameter of the interior surface of the outlet.

19. An apparatus comprising:

a vessel comprising an outlet that comprises:

a rim; and an interior surface that extends from the rim and defines a cavity; and a closure comprising:

a base portion; and a male portion that extends from the base portion and comprises:

a distally disposed undersized portion;

a proximally disposed oversized portion; and a tapered portion disposed between the undersized and oversized portions, wherein an annular space exists between the distally disposed undersized portion and the interior surface when the distally disposed undersized portion is disposed in the cavity and the proximally disposed oversized portion and the tapered portion are disposed outside the cavity, and wherein when the distally disposed undersized portion, the proximally disposed oversized portion, and the tapered portion are disposed in the cavity, the proximally disposed oversized portion receives radial compressive force from the interior surface that causes the distally disposed undersized portion to diametrically expand into the annular space, press radially outward against the interior surface, and form a seal with the interior surface.

20. The apparatus of claim 19, wherein the seal comprises a self-energizing seal, and wherein the vessel comprises inorganic material and the closure comprises thermoplastic material.

* * * * *